US009822777B2

(12) United States Patent
Adeleye

(10) Patent No.: US 9,822,777 B2
(45) Date of Patent: Nov. 21, 2017

(54) HYDRAULIC PUMPING ASSEMBLY, SYSTEM AND METHOD

(71) Applicant: Ayodele Adeleye, Fort Worth, TX (US)

(72) Inventor: Ayodele Adeleye, Fort Worth, TX (US)

(73) Assignee: i2r Solutions USA LLC, Keller, TX (US)

( * ) Notice: Subject to any disclaimer, the term of this patent is extended or adjusted under 35 U.S.C. 154(b) by 301 days.

(21) Appl. No.: 14/680,740

(22) Filed: Apr. 7, 2015

(65) Prior Publication Data

US 2015/0285243 A1 Oct. 8, 2015

Related U.S. Application Data

(60) Provisional application No. 61/976,480, filed on Apr. 7, 2014.

(51) Int. Cl.
*F04B 47/02* (2006.01)
*F04B 53/16* (2006.01)

(52) U.S. Cl.
CPC ..... *F04B 47/02* (2013.01); *F04B 47/026* (2013.01); *F04B 53/162* (2013.01)

(58) Field of Classification Search
CPC ..... F04B 15/02; F04B 17/04; F04B 19/003; F04B 19/22; F04B 23/02; F04B 47/02; F04B 47/026; F04B 49/06; F04B 49/22; F04B 53/10; F04B 53/147; F04B 53/16; F04B 53/162; F04B 53/146; E21B 2043/125; E21B 43/129; E21B 43/127; F15B 15/1471; F15B 2211/7057
USPC ..... 417/390, 528, 527; 166/377; 92/171.1, 92/165 R; 277/682, 422, 557, 551, 571
See application file for complete search history.

(56) References Cited

U.S. PATENT DOCUMENTS 1,689,794 A * 10/1928 Morris ..... F04B 53/12 417/528
2,251,868 A * 8/1941 Eckert ..... F04B 47/04 166/68
2,264,379 A * 12/1941 Hubbard ..... F04B 11/0025 92/108
2,332,763 A * 10/1943 Stewart ..... F16J 15/24 188/322.16
2,394,976 A * 2/1946 Boone ..... F04B 47/04 417/399

(Continued)

*Primary Examiner* — Devon Kramer
*Assistant Examiner* — Benjamin Doyle
(74) *Attorney, Agent, or Firm* — Corridor Law Group, P.C.

(57) ABSTRACT

A hydraulic pumping assembly provides reciprocating motion to a sucker rod string coupled to a downhole pump. The pumping assembly includes a hydraulic cylinder, a cylinder rod, a telescoping cylinder sleeve for increasing the effective stroke length, and a cylinder base positioned below the hydraulic cylinder. The hydraulic cylinder includes a cylinder barrel, a cylinder head, a piston, and a port configured to direct hydraulic fluid to and from the cylinder barrel. The piston is coupled to the cylinder rod at an upper end of the rod. The cylinder rod slides within the cylinder sleeve, which passes slideably through the cylinder head. The cylinder sleeve moves between an extended position and a retracted position as the piston reciprocates within the cylinder barrel. The cylinder base accommodates the cylinder rod and the telescoping cylinder sleeve in a collapsed position.

19 Claims, 20 Drawing Sheets

(56) References Cited

U.S. PATENT DOCUMENTS 2,668,517 A * 2/1954 Craft ..... F04B 47/04 166/79.1
2,708,912 A * 5/1955 Vanalstyne ..... F04B 47/04 417/904
2,770,197 A * 11/1956 Deitrickson ..... F04B 47/04 417/390
2,838,910 A * 6/1958 Bacchi ..... F04B 47/04 91/216 B
2,874,641 A * 2/1959 McCandlish ..... F04B 47/04 166/62
2,990,816 A * 7/1961 Vincent ..... F04B 47/12 417/904
3,128,674 A * 4/1964 Ganchar ..... F15B 15/16 91/167 R
3,236,339 A * 2/1966 Duckett ..... F16F 9/061 188/320
3,269,275 A * 8/1966 Waite ..... F15B 15/1409 91/169
3,669,572 A * 6/1972 King ..... F01L 25/063 417/390
3,782,117 A * 1/1974 James ..... F04B 47/04 417/904
4,047,384 A * 9/1977 Saruwatari ..... F03C 1/007 417/904
4,140,044 A * 2/1979 Biller ..... F16J 10/02 91/402
4,187,765 A 2/1980 Mattoon
4,191,016 A 3/1980 Roth et al.
4,206,684 A * 6/1980 Gosney ..... F15B 15/16 91/167 R
4,250,440 A * 2/1981 Lee ..... G05B 11/18 318/614
4,448,110 A 5/1984 Polak et al.
4,503,752 A 3/1985 Olson et al.
4,616,981 A * 10/1986 Simmons ..... F04B 47/08 417/378
4,646,517 A * 3/1987 Wright ..... F04B 47/04 60/369
4,647,026 A * 3/1987 Siemann ..... F16F 9/516 188/281
4,653,383 A 3/1987 Henderson
4,691,511 A 9/1987 Dollison
4,696,221 A * 9/1987 Dollison ..... F04B 47/04 137/624.13
4,712,374 A 12/1987 Stewart
4,762,473 A * 8/1988 Tieben ..... E21B 43/127 417/399
4,936,193 A * 6/1990 Stoll ..... B23Q 11/0825 220/8
4,987,823 A 1/1991 Taplin et al.
5,322,004 A 6/1994 Sims
5,447,026 A * 9/1995 Stanley ..... F04B 9/105 277/322
5,586,482 A * 12/1996 Leonard ..... F15B 11/036 91/519
5,613,418 A * 3/1997 Guido ..... F15B 11/036 91/167 R
5,934,175 A * 8/1999 Vatel ..... F15B 15/1419 277/435
5,996,688 A 12/1999 Schultz et al.
6,053,709 A * 4/2000 Reavis ..... F04B 9/135 417/401
6,589,027 B2 * 7/2003 Ursan ..... F03C 1/0076 417/398
6,626,438 B2 * 9/2003 Walden ..... F15B 15/16 277/510
6,722,260 B1 * 4/2004 Brown ..... G01D 5/48 324/642
7,204,104 B2 * 4/2007 Kim ..... D06F 37/20 188/284
7,621,364 B2 * 11/2009 Haglund ..... B60R 21/38 180/274
7,762,321 B2 * 7/2010 Fesi ..... E21B 43/126 166/105
8,082,734 B2 * 12/2011 St. Denis ..... F04B 9/02 60/369
8,235,107 B2 8/2012 Fesi et al.
8,387,990 B2 * 3/2013 Castleman ..... F16J 15/3236 277/309
8,523,543 B2 * 9/2013 St. Denis ..... F04B 47/02 166/68.5
9,567,838 B2 * 2/2017 Marshall ..... E21B 43/126
2003/0156960 A1 * 8/2003 Wang ..... F04B 33/00 417/528
2003/0231970 A1 * 12/2003 Yang ..... F04B 33/00 417/528
2005/0067242 A1 * 3/2005 Vanmechelen ..... F16F 9/3242 188/322.17
2006/0275161 A1 * 12/2006 St. Denis ..... F04B 53/10 417/415
2007/0014673 A1 * 1/2007 Rutz ..... F04B 49/06 417/53
2007/0286750 A1 * 12/2007 Beck ..... F04B 47/02 417/415
2007/0296242 A1 * 12/2007 Frommer ..... E05F 15/43 296/146.4
2008/0240930 A1 * 10/2008 Palka ..... E21B 43/127 417/42
2009/0104059 A1 * 4/2009 Wang ..... F04B 33/005 417/468
2009/0194291 A1 * 8/2009 Fesi ..... E21B 43/126 166/369
2009/0205827 A1 * 8/2009 Swietlik ..... E21B 19/08 166/285
2009/0308243 A1 * 12/2009 Tillaart ..... E02F 9/2271 92/171.1
2010/0300679 A1 12/2010 Lorimer et al.
2014/0000866 A1 1/2014 St. Denis
2014/0368152 A1 * 12/2014 Pasche ..... F04B 49/02 318/805
2015/0017037 A1 * 1/2015 Hocker ..... F04B 1/0408 417/471
2015/0285243 A1 * 10/2015 Adeleye ..... F04B 47/02 417/53

* cited by examiner

HYDRAULIC PUMPING ASSEMBLY, SYSTEM AND METHOD

CROSS-REFERENCE TO RELATED APPLICATIONS

This application claims priority benefits from U.S. provisional patent application No. 61/976,480 filed on Apr. 7, 2014, entitled "Hydraulic Pumping Assembly, System and Method," The '480 application is hereby incorporated by reference herein in its entirety.

FIELD OF THE INVENTION

The present invention relates to a pumping assembly, system and method that can be used for pumping liquids from a well, such as an oil well.

BACKGROUND OF THE INVENTION

This application relates to a type of "artificial lift system" commonly referred to as a "reciprocating rod lift". A reciprocating rod lift that is used in extracting crude oil from an underground well generally comprises a surface pumping assembly, a downhole pump and a rod string, which is a series of sucker rods that connects the surface pumping assembly to the downhole pump. The rod string is connected to the surface pumping assembly via a polished rod at a "polished rod connection". The polished rod is typically the uppermost rod in the rod string, and enables an efficient hydraulic seal to be made around the reciprocating rod string at the wellhead. The rod string extends into the ground within a tubing and casing which extends to the oil formation. The downhole pump is submerged within the oil formation. The surface pumping assembly provides a reciprocating upstroke and downstroke motion which allows the downhole pump to be filled and to lift a column of oil to the surface.

Some surface pumping assemblies comprise a hydraulic cylinder mounted on the wellhead. The hydraulic cylinder comprises a piston connected to the rod string via a polished rod connection. An associated hydraulic power unit (HPU) provides pressurized hydraulic fluid to lift, the piston within the cylinder, and thereby lift the attached rod string (on the upstroke). On the downstroke the piston and the attached rod string drops at a controlled rate (under gravity or by the application of pressure). The stroke length is the distance between the uppermost position and the lowest position of the polished rod during its reciprocating motion.

FIGS. 1-5 are simplified cross-sectional views illustrating some different types of (prior art) hydraulic cylinders that have been employed in reciprocating rod lifts. In each of the examples illustrated in FIGS. 1-5, a hydraulic power unit (not shown) can be used to supply pressurized fluid to the piston within the hydraulic cylinder to provide the upstroke and, optionally, the downstroke motion. A directional control valve is typically used on the HPU to reverse the direction of the piston when an upper or lower proximity sensor is triggered directly, or more commonly indirectly, by movement of the piston.

In pumping assembly 100 shown in FIG. 1, hydraulic cylinder 110 is mounted on mast 115 which is, in turn, mounted to wellhead 120 via wellhead mount 117. Piston 125 moves up and down in cylinder 110 under the influence of a hydraulic fluid introduced and discharged via port 112. Hydraulic fluid can also be introduced and discharged via port 114. Piston 125 is coupled to the upper end of cylinder rod 130, which is coupled to polished rod 140 via polished rod connection 145. Polished rod 140 is coupled to a sucker rod string not shown) which extends into the underground well. Proximity sensors 150 and 155 are mounted on mast 115, and are triggered by sensing metal protrusion 148 on polished rod connection 145 at the bottom and top of the stoke, respectively. Stuffing box 160 provides a seal around polished rod 140 to prevent, or at least reduce, leakage of the pumped fluid, such as crude oil. Designs similar to the pumping assembly of FIG. 1 are described, for example, in U.S. Pat. Nos. 7,762,321 and 8,235,107. In pumping assembly 100, the height of the structure is more than twice the maximum stroke length above the polished rod connection, and the cylinder rod is generally visible moving up and down within the mast. Typically support lines are needed to support or stabilize the mast.

FIG. 2 shows pumping assembly 200 in which hydraulic cylinder 210 is mounted directly on wellhead 220. Piston 225 moves up and down in cylinder 210 under the influence of a hydraulic fluid introduced and discharged via port 212. Hydraulic fluid can also be introduced and discharged via port 214. Piston 225 is coupled directly to the upper end of polished rod 240. Polished rod 240 is coupled to a rod string (not shown) which extends into the underground well. Cylinder seal gland assembly 209 provides a seal around polished rod 240. Proximity sensors (not shown in FIG. 2) can be incorporated into the pumping assembly and used to control the motion of the piston. This type of design is described, for example, in U.S. Pat. No. 4,503,752. With this design the height of the pumping assembly is only a bit greater than the stroke length, and the pumping assembly is relatively simple and compact. The polished rod contacts both the crude oil (or other fluid being pumped) and the hydraulic fluid within the cylinder, which can result in detrimental cross-contamination, even with the presence of seals. Also with this design, in order to access the well for servicing, as well as removing the surface pumping assembly, it is also generally necessary to uncouple the polished rod from the rod string. The connection point is typically within the well.

In pumping assembly 300 shown in FIG. 3 the mast is also eliminated. Hydraulic cylinder 310 is mounted to wellhead 320 via wellhead mount 317. In this case, hydraulic cylinder 310 is an annular cylinder with central, cylindrical cavity (or bore) 315 defined by interior cylindrical wall 313. Annular piston 325 moves up and down in cylinder 310 under the influence of a hydraulic fluid introduced and discharged via port 312. Hydraulic fluid can also be introduced and discharged via port 314. Piston 325 is coupled to hollow cylinder rod 330 that surrounds interior cylinder wall 313. Polished rod 340 is located axially in hydraulic cylinder 310 within cavity 315, and is coupled to an upper portion of hollow cylinder rod 330 via polished rod connection 345. Proximity sensors 350 and 355 are mounted on non-metal pipe 370 positioned adjacent hydraulic cylinder 310, and are triggered by sensing metal part 348 connected to polished rod connection 345 via string 372 positioned to move up and down within pipe 370. Stuffing box 360 provides a seal around polished rod 340 to prevent, or at least reduce, leakage of pumped fluid. In pumping assembly 300, when the piston is in the down position the height of the structure is only a little more than one stroke length above the wellhead, but at the top of the upstroke the hollow cylinder rod will extend approximately another stroke length above the wellhead, and will be visible moving up and down. The hollow cylinder rod will be exposed to the external environment as it protrudes above the cylinder. The annular cylinder and piston require additional seals as compared to the arrangements shown in FIGS. 1 and 2.

Other designs are known in which a combination of hydraulic cylinders (similar to those shown in FIG. 1) and accumulators are mounted on the wellhead via a wellhead mount and are coupled to move the polished rod up and down. For example, FIG. 4 shows pumping assembly 400 in which two hydraulic cylinders 410*a* and 410*b* are mounted to wellhead 420 via wellhead mount 417. Pistons 425*a* and 425*b* move up and down in cylinders 410*a* and 410*b*, respectively, under the influence of a hydraulic fluid introduced and discharged via ports 412*a* and 412*b*, respectively. Hydraulic fluid can also be introduced and discharged via ports 414*a* and 414*b*. Pistons 425*a* and 425*b* are coupled to cylinder rods 430*a* and 430*b*, respectively. Leveling plate 415 connects cylinder rods 430*a* and 430*b*. Polished rod 440 is located in a space between hydraulic cylinders 410*a* and 410*b*, and is coupled to an upper portion of leveling plate 415 via polished rod connection 445. Proximity sensors 450 and 455 are mounted on non-metal pipe 470 positioned adjacent hydraulic cylinders 410*a* and 410*b*, and are triggered by sensing metal part 448 connected to polished rod connection 445 via string 472 positioned to move up and down within pipe 470. Stuffing box 460 provides a seal around polished rod 440. U.S. Patent Application Publication No. 2010/0300679 describes a similar assembly with two hydraulic cylinders and two accumulators. As with the design shown in FIG. 3, when the pistons are in the down position the height of the structure is only a little more than one stroke length above the wellhead, but at the top of the upstroke the cylinder rods will extend approximately another stroke length above the wellhead, and will be visible moving up and down. The cylinder rods will be exposed to the external environment as they protrude above the cylinders.

The pumping assembly 500 shown in FIG. 5 includes a mechanism which aids in reducing the overall height of the assembly. Again hydraulic cylinder 510 is mounted to wellhead 520 via wellhead mount 517. Piston 525 moves up and down in cylinder 510 under the influence of a hydraulic fluid introduced and discharged via port 512. Hydraulic fluid can also be introduced and discharged via port 514. Piston 525 is coupled to the lower end of cylinder rod 530. Pumping assembly 500 comprises sheave/drum assembly 516 over which cable or belt 515 is looped. Cable 515 is secured to wellhead mount 517 and to polished rod connection 545. Polished rod 540 is coupled to a rod string (not shown) which extends into the underground well. The cable and sheave/drum assembly causes the polished rod to move twice the distance travelled by the piston, thus the height of the hydraulic cylinder is only approximately half of the stroke length. However, the cylinder (piston) has to lift approximately double the rod string load; thus requiring a higher operating pressure from the HPU for similar rod string load and cylinder geometry when compared to other conventional arrangements. The wellhead mount is therefore designed for twice the rod string load along with desired safety factors. Similar to pumping assembly 400, proximity sensors 550 and 555 are mounted on non-metal pipe 570 mounted adjacent hydraulic cylinder 510, and are triggered by sensing metal part 548 connected to string 572 positioned to move up and down within pipe 570 in conjunction with movement of polished rod 540. Stuffing box 560 provides a seal around polished rod 540. In this arrangement the cylinder is off-set from the rod string which can allow easier access to the well, as the pumping assembly may not need to be moved.

The present apparatus and method relate to a compact pumping assembly and associated system and method. The pumping assembly is relatively easy to install and maintain, and can offer other advantages in design and operation as described below.

SUMMARY OF THE INVENTION

A hydraulic pumping assembly provides reciprocating motion to a sucker rod string coupled to a downhole pump. The hydraulic pumping assembly comprises:

(a) a hydraulic cylinder comprising:
  (i) a cylinder barrel;
  (ii) a cylinder cap at an upper end of the cylinder barrel;
  (iii) a cylinder head at a lower end of the cylinder barrel;
  (iv) a piston; and
  (v) at least one port configured to direct hydraulic fluid to and from the cylinder barrel, to cause the piston to reciprocate within the cylinder barrel;

(b) a cylinder rod, the piston coupled to an upper end of the cylinder rod;

(c) a telescoping cylinder sleeve, wherein the cylinder rod slides within the cylinder sleeve and the cylinder sleeve passes slideably through the cylinder head, and wherein the cylinder sleeve telescopically moves between an extended position and a retracted position as the piston reciprocates within the cylinder barrel; and (d) a cylinder base positioned below the hydraulic cylinder, the cylinder base accommodating the cylinder rod and the telescoping cylinder sleeve in a collapsed position.

In some embodiments of the pumping assembly, after a downstroke period, the piston is located toward the bottom of the cylinder barrel and the telescoping cylinder sleeve surrounds the cylinder rod and is collapsed within the cylinder base.

In some embodiments, during an upstroke period the piston and the cylinder rod move up and, once the cylinder rod is almost fully retracted within the cylinder barrel, a feature associated with the cylinder rod engages the cylinder sleeve causing the cylinder sleeve to be drawn out from the cylinder base and into the cylinder barrel.

In some embodiments, during the downstroke period, the piston pushes the cylinder sleeve back into the cylinder base.

In some embodiments, the hydraulic pumping assembly further comprises (e) a polished rod connection for coupling a lower end of the cylinder rod to the sticker rod string via a polished rod.

In some embodiments, a first port is located in the cylinder head. A second port can be located in the cylinder cap.

In the foregoing embodiments, the pumping assembly can further comprise a wellhead mount for coupling the pumping assembly to a wellhead. The wellhead mount can be coupled below the cylinder base.

In the foregoing embodiments, the hydraulic pumping assembly can further comprise a linear transducer for directly or indirectly sensing a position of the piston within the cylinder barrel.

In the foregoing embodiments, the hydraulic pumping assembly can further comprise at least one proximity sensor for directly or indirectly sensing a position of the piston within the cylinder barrel. The at least one proximity sensor can comprise an upper proximity sensor for sensing when the piston reaches a desired upstroke position, a lower proximity sensor for sensing when the piston reaches a desired downstroke position, and a transition proximity sensor for sensing when the cylinder sleeve is drawn into the cylinder barrel. The proximity sensors can comprise inductive proximity switches.

In the present approach, the polished rod and the cylinder rod need not extend above the top of the hydraulic cylinder during operation of the hydraulic pumping assembly.

A method for operating the previously-described hydraulic pumping assembly embodiments comprises supplying a hydraulic fluid to lift the piston within the cylinder barrel during an upstroke, and adjusting the flow rate of a hydraulic fluid supplied to lift the piston such that the piston maintains substantially the same linear speed before and after the telescoping cylinder sleeve retracts into the cylinder barrel during the upstroke.

In some embodiments of the method, a recapture mechanism is utilized to obtain energy from a gravity-driven downstroke of the piston.

A system provides reciprocating motion to a sucker rod string coupled to a downhole pump. The system comprises a hydraulic pumping assembly, and a hydraulic power unit for directing a hydraulic fluid to and from the hydraulic pumping assembly. The hydraulic power unit comprises:

(I) a reservoir containing the hydraulic fluid;

(II) a pump fluidly connected to the reservoir;

(III) a motor connected to a variable frequency drive, and coupled to drive the pinup;

(IV) a hydraulic manifold assembly for fluidly coupling the reservoir to the cylinder barrel; and (V) a controller configured to control the variable frequency drive thereby controlling the speed of the motor and the flow rate of the hydraulic fluid to the cylinder barrel via the hydraulic manifold assembly.

In various embodiments of the system, the hydraulic pumping assembly can be any of the previously-described hydraulic pumping assembly embodiments.

In some embodiments of the system the hydraulic manifold assembly comprises a plurality of valves. For example, it can comprise a proportional directional control valve and a solenoid on/off valve, or it can comprise a solenoid-operated directional control valve and a manually operated directional control valve.

In some embodiments of the system, the hydraulic pumping assembly further comprises a linear transducer for directly or indirectly sensing a position of the piston within the cylinder barrel, and the controller is configured to control direction and speed of the piston based on signals from the linear transducer. The hydraulic pumping assembly can instead (or in addition) comprise at least one proximity sensor for directly or indirectly sensing a position of the piston within the cylinder barrel. The at least one proximity sensor can comprise an upper proximity sensor for sensing when the piston reaches a desired upstroke position, a lower proximity sensor for sensing when the piston reaches a desired downstroke position, and a transition proximity sensor for sensing when the cylinder sleeve is drawn into the cylinder barrel. The controller can be configured to control direction and speed of the piston based on signals from the upper, lower and transition proximity sensors. The controller can be further configured to adjust the speed of the piston when the transition proximity sensor is triggered.

A method for operating the previously-described system embodiments comprises supplying a hydraulic fluid to lift the piston within the cylinder barrel during an upstroke, and adjusting the flow rate of a hydraulic fluid supplied to lift the piston such that the piston maintains substantially the same linear speed before and after telescoping cylinder sleeve retracts into the cylinder barrel during the upstroke.

In some embodiments of the method for operating the system, the controller adjusts the variable frequency drive thereby controlling the speed of the motor and the flow rate of the hydraulic fluid such that the piston maintains substantially the same linear speed before and after the telescoping cylinder sleeve retracts into the cylinder barrel during the upstroke. The controller can be configured to control direction and speed of the piston based on signals from a linear transducer that directly or indirectly senses a position of the piston within the cylinder barrel. The controller can be configured to control direction and speed of the piston based on signals from upper, lower and transition proximity sensors that directly or indirectly sense a position of the piston within the cylinder barrel. The controller can also be configured to reduce the speed of the piston when a transition proximity sensor is triggered indicating the telescoping cylinder sleeve has begun to retract into the cylinder barrel. In some embodiments of the method for operating the system, a recapture mechanism is utilized to obtain energy from a gravity-driven downstroke of the piston.

DETAILED DESCRIPTION OF PREFERRED EMBODIMENT(S)

Figure 6:
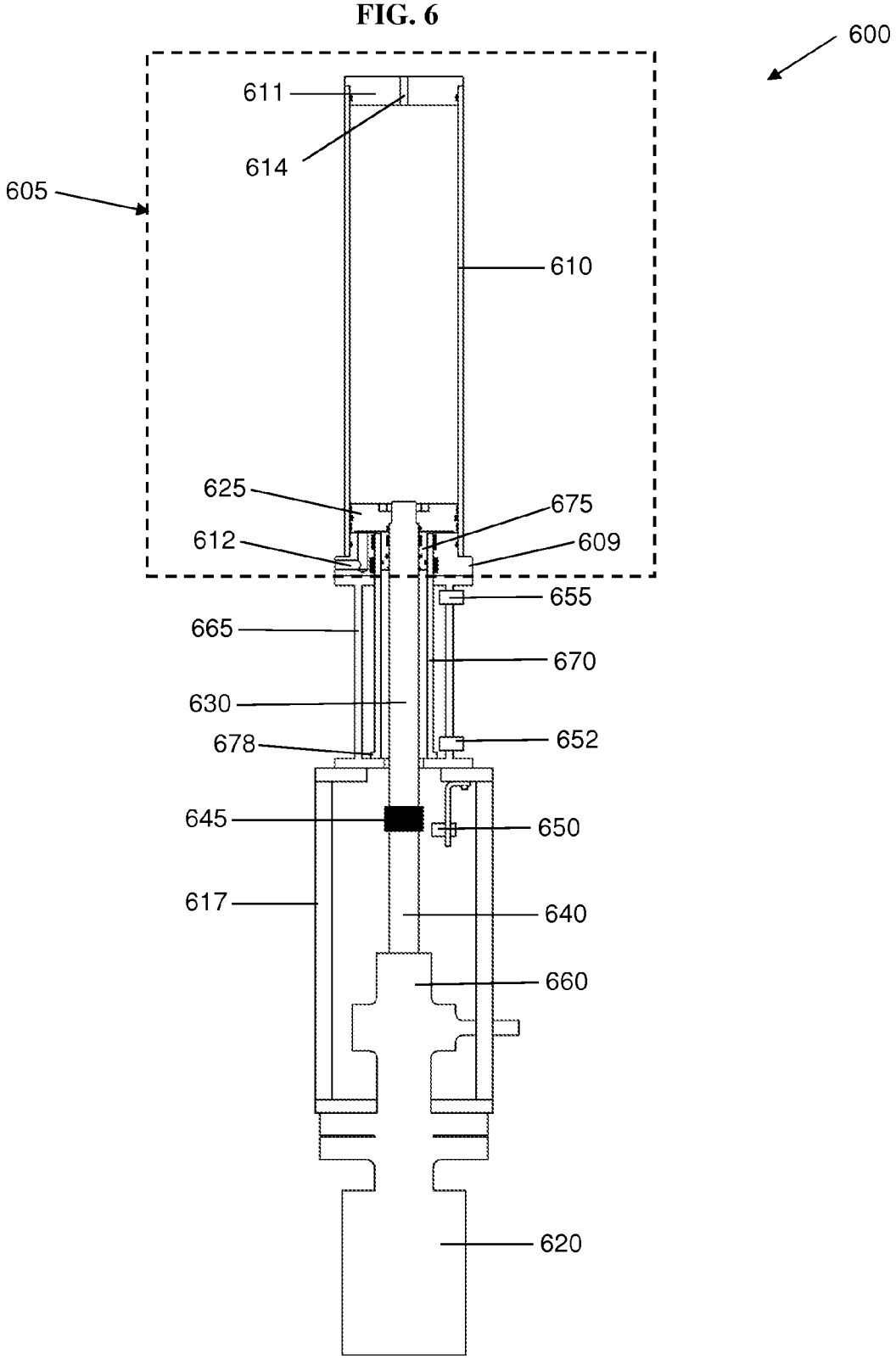
FIG. 6 is a simplified cross-sectional view of an embodiment of a pumping assembly, comprising a telescoping cylinder sleeve, and a hydraulic cylinder assembly shown in an extended position.
Figure 7:
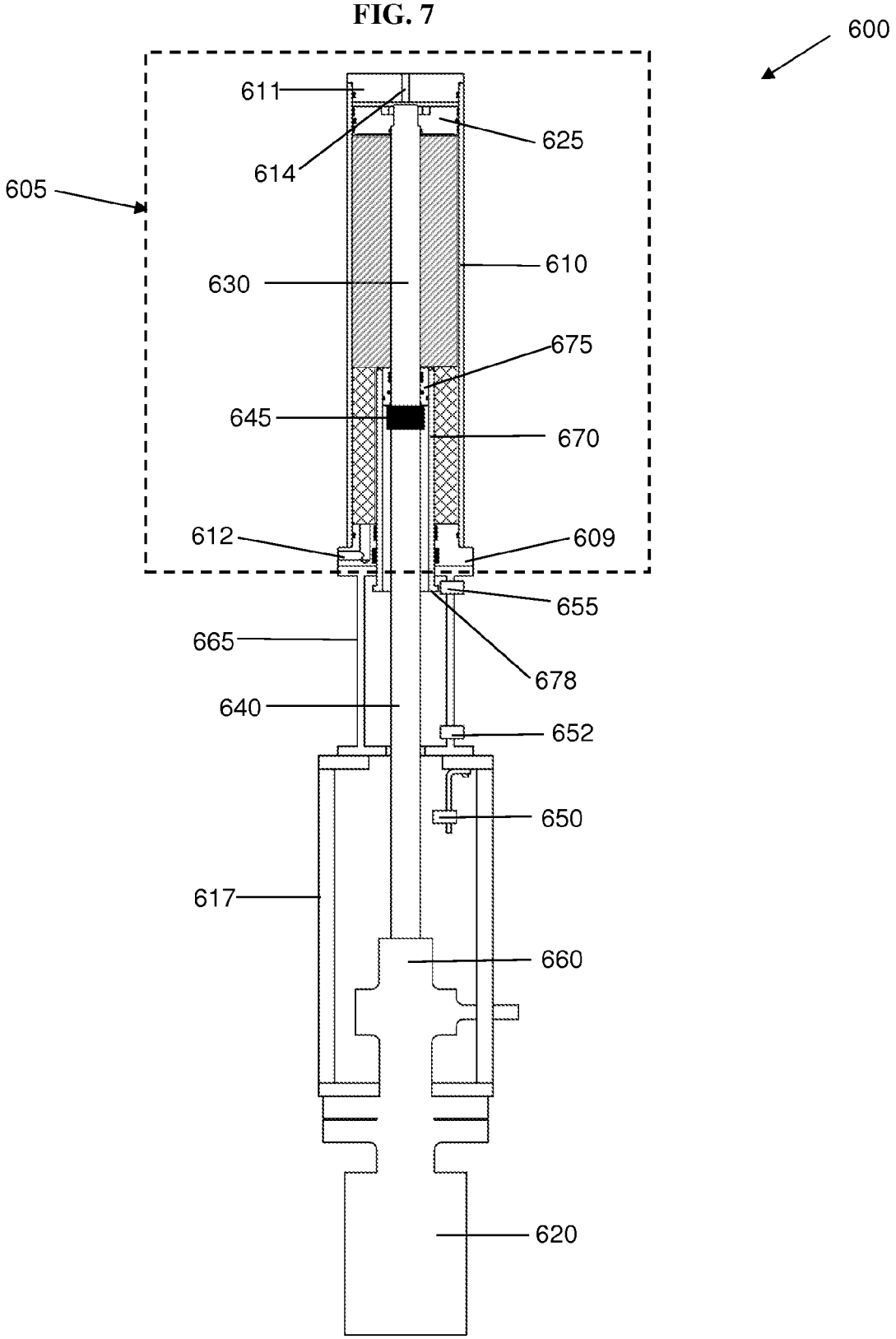
FIG. 7 is a simplified cross-sectional view of an embodiment of a pumping assembly, comprising a telescoping cylinder sleeve, and a hydraulic cylinder assembly shown in a retracted position.
Figure 8:
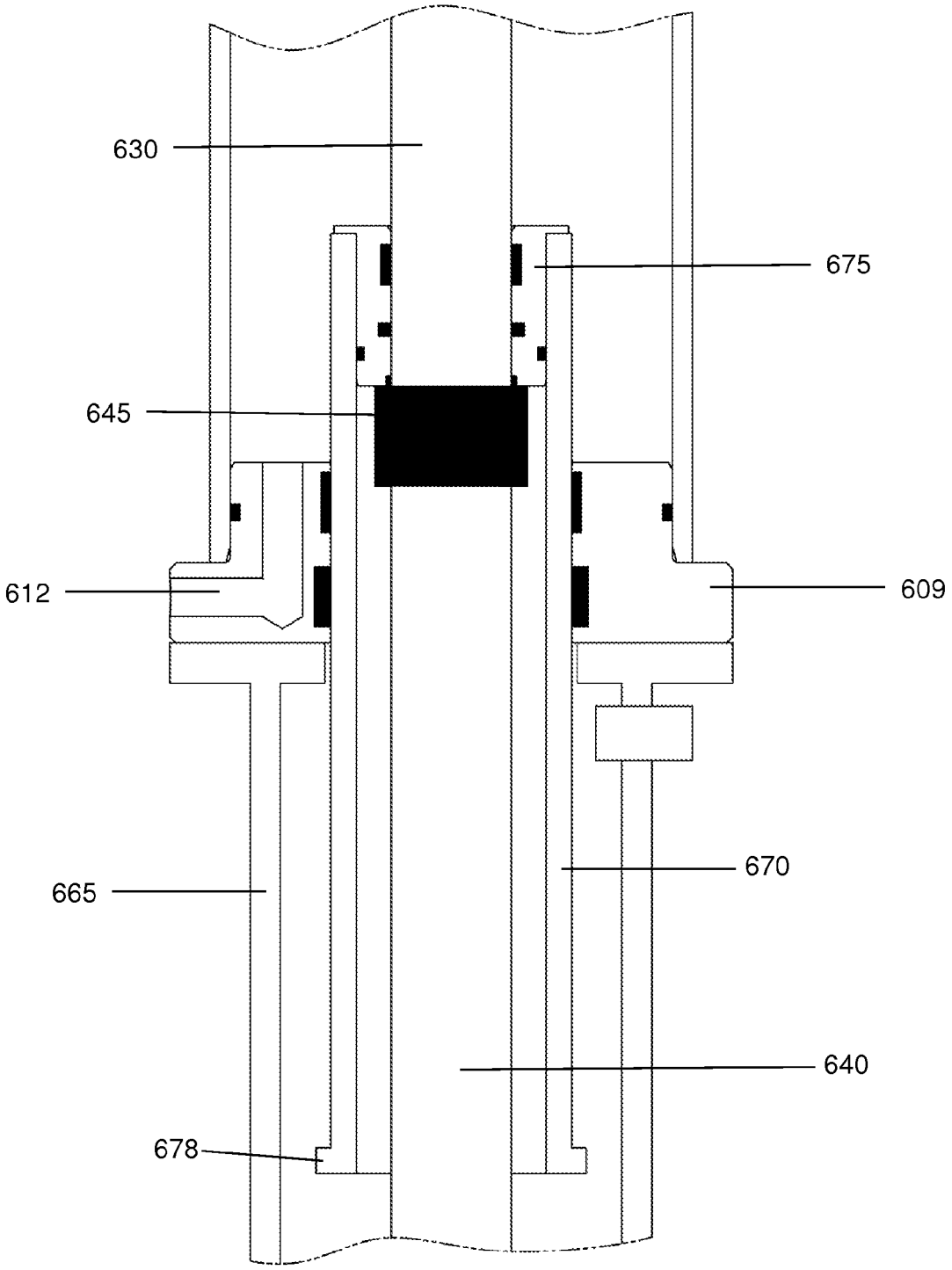
FIG. 8 is a simplified cross-sectional close-up view of a portion of the pumping assembly of FIGS. 6 and 7.

FIGS. 6-8 are simplified cross-sectional views of a pumping assembly. These diagrams are not to scale and the dimensions have been deliberately exaggerated (particularly in the x-direction, namely, width-wise) to more clearly illustrate various components of the assembly.

FIGS. 6 and 7 show pumping assembly 600 comprising hydraulic cylinder 605, shown in an extended position in FIG. 6, and in a retracted position in FIG. 7. Pumping assembly 600 is mounted to wellhead 620 via wellhead mount 617. Polished rod 640 extends through stuffing box 660 and is coupled to a rod string (not shown) which extends into the underground well. Polished rod 640 is coupled to the lower end of cylinder rod 630 via polished rod connection 645. Piston 625 is coupled to the upper end of cylinder rod 630. Piston 625 moves up and down in cylinder barrel 610 under the influence of a hydraulic fluid introduced/discharged via lower port 612 in cylinder head 609 and/or upper port 614 in cylinder cap 611. Pumping assembly 600 also comprises cylinder base 665 positioned between hydraulic cylinder 605 and wellhead mount 617, and telescoping cylinder sleeve 670. Cylinder sleeve 670 effectively reduces the length of cylinder rod 630 for a given maximum stroke length. In an extended position (for example, at the bottom of the downstroke), piston 625 is located toward the bottom of cylinder barrel 610, and telescoping cylinder sleeve 670 is fully collapsed within cylinder base 665 as shown in FIG. 6. During the upstroke, as hydraulic fluid causes piston 625 to move up within cylinder barrel 610, cylinder rod 630 and polished rod 640 are lifted. Once piston 625 is about half way up cylinder barrel 610, polished rod connection 645 engages gland 675 within cylinder sleeve 670 causing it to be drawn out of cylinder base 665, and to retract into cylinder barrel 610. Eventually piston 625 approaches the top of cylinder barrel 610 (at the top of the upstroke) and sleeve 670 is almost fully retracted within cylinder barrel 610, as shown in FIG. 7. On the downstroke, piston 625 moves down and eventually pushes sleeve 670 back into a collapsed position within cylinder base 665 as shown in FIG. 6. In some situations, the cylinder sleeve can begin to collapse into cylinder base 665 on the downstroke before it is contacted by the piston. A speed cushion (controlled acceleration/deceleration of the piston) can be implemented in the control system at the top and bottom of the stroke to prevent, or at least reduce, an abrupt change when transitioning from the upstroke to the downstroke. This can reduce stresses in the rod string.

Cylinder sleeve 670 has a larger outer diameter than cylinder rod 630, so it occupies greater volume per unit length as it retracts within cylinder baud 610. Thus, there are two different flow cross-sections associated with movement of the cylinder rod and cylinder sleeve, as shown in FIG. 7—the first flow cross-section is shown shaded, and the second (reduced) flow cross-section surrounding cylinder sleeve 670 retracted within cylinder barrel 610 is shown cross-hatched. This change in flow cross-section means that for a given volumetric flow rate of hydraulic fluid into the lower chamber of cylinder 605, piston 625 will move more quickly once cylinder sleeve 670 begins to be drawn up within cylinder barrel 610. This change can be compensated for by adjusting a flow rate of hydraulic fluid during the upstroke to maintain a substantially constant linear speed of the piston, so that the piston moves at substantially the same linear speed during retraction of the cylinder sleeve as it was moving prior to retraction of the cylinder sleeve, as described in further detail below. Optionally, the linear speed of the piston can be controlled so that it is also maintained substantially the same before and after telescoping cylinder sleeve 670 collapses into cylinder base 665 during the downstroke. This can be accomplished, for example, by employing an electronic proportional flow control valve (not shown) to control a flow rate of fluid exiting the hydraulic cylinder.

Engagement of polished rod connector 645 with gland 675 within cylinder sleeve 670 is more clearly illustrated in FIG. 8, in which cylinder sleeve 670 is shown partially retracted within cylinder barrel 610. Other suitable features or mechanisms can be used to cause the cylinder sleeve to be retracted as the cylinder rod moves up. For example, the lower portion of the cylinder rod can comprise an integral flange or shoulder that engages with a gland or other protrusion within the sleeve.

Referring again to FIGS. 6 and 7, pumping assembly 600 further comprises three proximity sensors 650, 652 and 655. Lower proximity sensor 650 is attached to wellhead mount 617, below cylinder base 665 and is triggered by movement of polished rod connection 645 past it. Transition and upper proximity sensors, 652 and 655 respectively, are mounted within cylinder base 665 and are triggered by ring or flange feature 678 at the lower end of cylinder sleeve 670. Upper proximity sensor 655 can be mounted at one of a series of positions along the height of cylinder base 665 to set a desired stroke length. Operation of proximity sensors 650, 652 and 655 is described in further detail below. Proximity sensors can be mounted in other suitable locations and can be triggered by other mechanisms. Sensors 650, 652 and 655 can be inductive proximity switches. Other suitable sensors can be used to provide input signals the controller can use to control piston direction, speed and stroke length. For example, a system comprising a linear transducer is described below in reference to FIG. 19.

Figure 9:
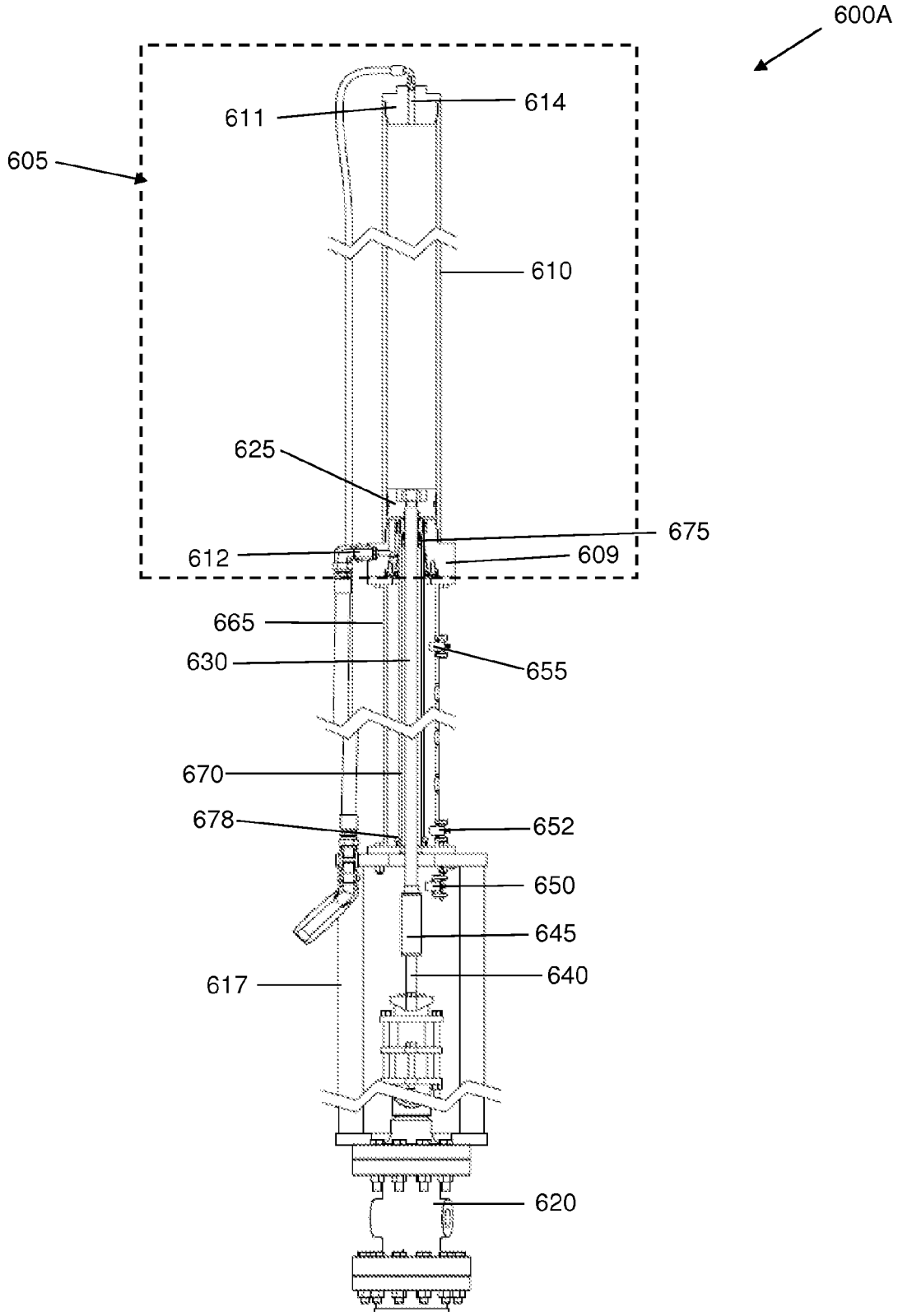
FIG. 9 is a more detailed cross-sectional view of an embodiment of a pumping assembly, comprising a telescoping cylinder sleeve, and a hydraulic cylinder assembly shown in an extended position.
Figure 10:
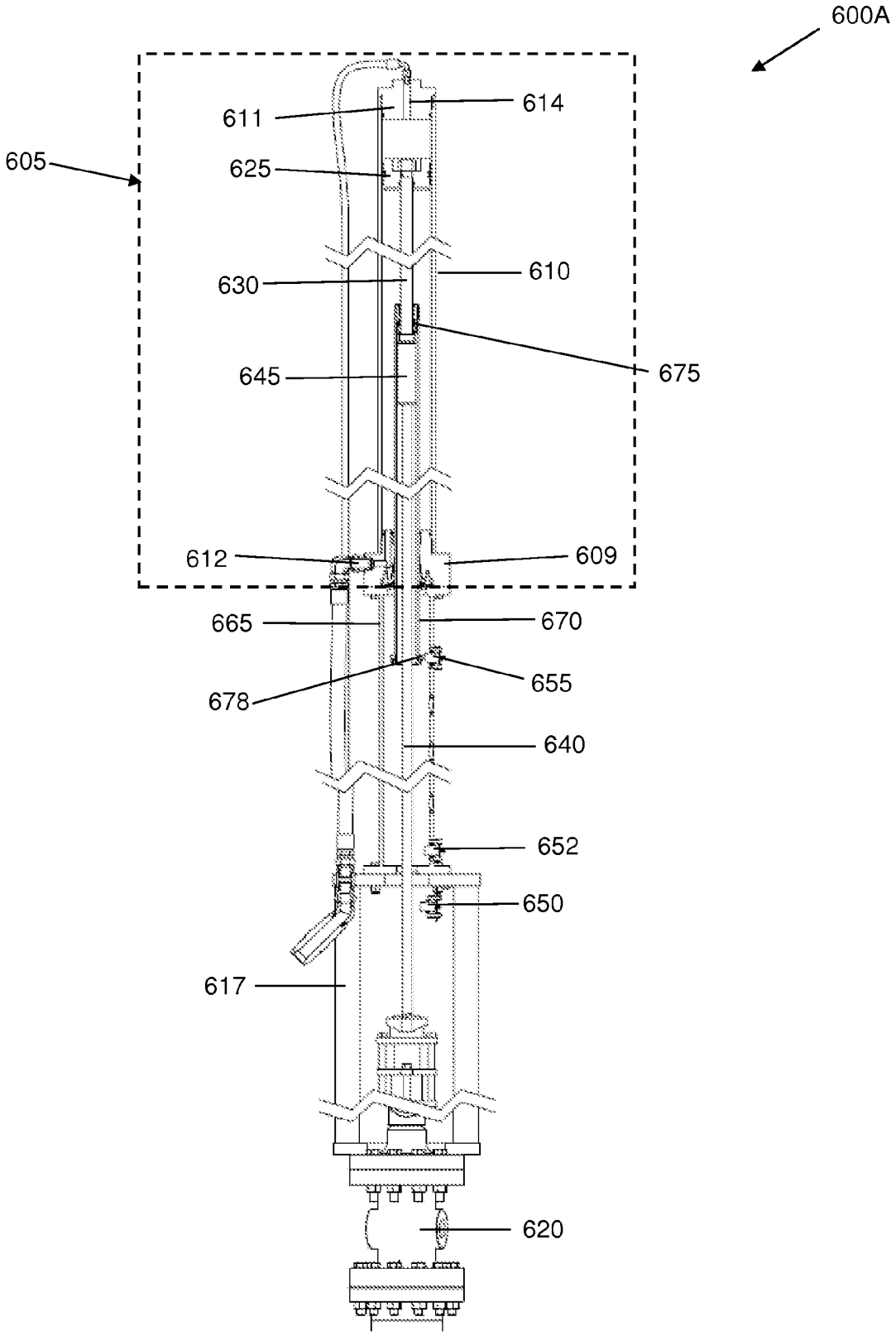
FIG. 10 is a more detailed cross-sectional view of an embodiment of a pumping assembly, comprising a telescoping cylinder sleeve, and a hydraulic cylinder assembly shown in a retracted positions.

FIGS. 9 and 10 are more detailed engineering drawings showing cross-sectional views of pumping assembly 600A similar to that illustrated in FIGS. 6 and 7, again shown with the hydraulic cylinder in an extended and a retracted position, respectively. The same reference numerals are used in FIGS. 9 and 10 to denote components that are similar to or the same as those described in reference to FIGS. 6 and 7.

The pumping assembly described herein can be mounted to a wellhead via a wellhead mount as shown. The cylinder base and cylinder sleeve can eliminate, or at least reduce, the need for spacing the hydraulic cylinder a full maximum stroke length above the polished rod connection. Roughly half of the stroke length of the polished rod is accomplished outside the cylinder barrel and the other half is accomplished within the sleeve as it is drawn into the cylinder barrel. This can eliminate, or at least reduce, the need for a mast that is taller than the stroke length and can significantly reduce the height and weight of the overall assembly. In other embodiments of the present pumping assembly, the length of the cylinder rod and cylinder base can be reduced even further by having two or more concentric, telescoping cylinder sleeves surrounding the cylinder rod.

Another advantage of the present assembly is that there is limited exposure of the moving parts to the surrounding environment. The stroke occurs within the cylinder base and the cylinder barrel, thus neither the polished rod nor the cylinder rod rise above the top of the hydraulic cylinder. In the present design, the only moving part that will typically be visible during operation of the assembly is the small exposed portion of the polished rod above the well-head and below the cylinder base. Furthermore, the polished rod is lifted within the volume of the cylinder barrel, but does not come in contact with the hydraulic fluid. This prevents or reduces the likelihood of contamination of the hydraulic fluid in the cylinder by well-produced fluid (for example, crude oil) that could be introduced via, the polished rod. This also means the pumping assembly is adaptable to be used with most if not all, wells that utilize an "above stuffing box" polished rod connection without much modification.

The pumping assembly as described herein is relatively easy to install and to service. The cylinder base can be fastened to both the hydraulic cylinder and the wellhead mount in the factory or before it is brought to the installation site. This pre-assembled structure can then simply be fastened to a flange on the wellhead via the wellhead mount at the installation site. The cylinder rod is connected to the polished rod via a polished rod connection, for example, a polished rod coupling. This simple installation is both beneficial during installation and also during serving of the well equipment.

In order to access the wellhead (for example, for flush-by servicing), and in some cases to service the pumping assembly itself, the pumping assembly is generally detached from the wellhead mount and lifted aside, for example, using a crane. However, the pumping assembly can be designed so that it can be tilted to one side to provide convenient access to the wellhead or pumping assembly. The pumping assembly can be hinged, for example, at the cylinder base. In some such embodiments, a hydraulic mechanism can be used to tilt (lower) and raise the pumping assembly. Such a hydraulic mechanism can be coupled to the same HPU that is used to direct hydraulic fluid to and from the pumping assembly.

In some embodiments, the upper proximity sensor is not located at the top of the hydraulic cylinder as is usually the case with other pumping assemblies; rather, it is located within the cylinder base which is more accessible and can eliminate the need for servicing that component at a high elevation.

Figure 11:
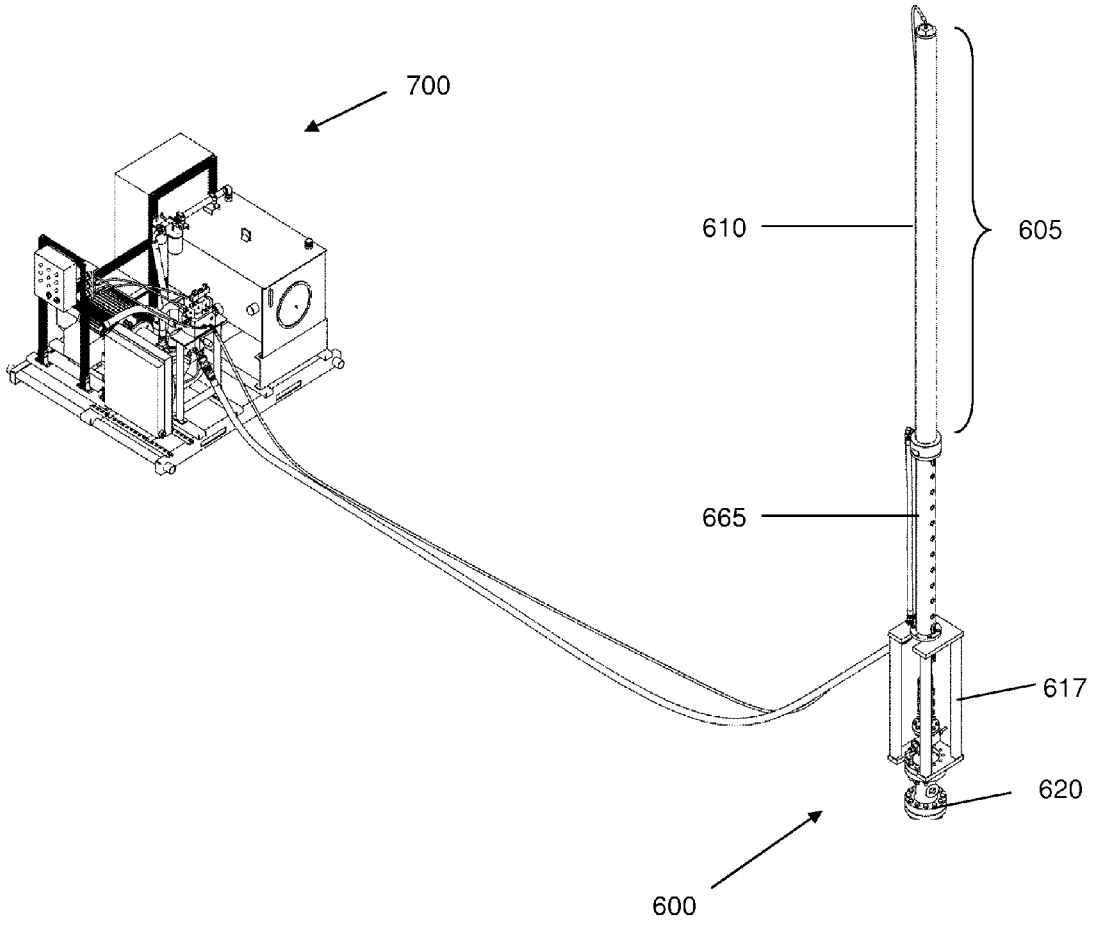
FIG. 11 is an isometric view showing a hydraulic power unit (HPU) coupled to direct hydraulic fluid to and from a pumping assembly.

FIG. 11 is an isometric view of a system comprising hydraulic power unit (HPU) 700 coupled to direct hydraulic fluid to and from pumping assembly 600 (such as illustrated in FIGS. 6, 7, 9 and 10). The same reference numerals are used in FIG. 11 to denote components of pumping assembly 600 that are similar to or the same as those described above. HPU 700 supplies pressurized fluid to hydraulic cylinder 605 in pumping assembly 600 to lift piston 625 and thereby lift the rod string.

Figure 12:
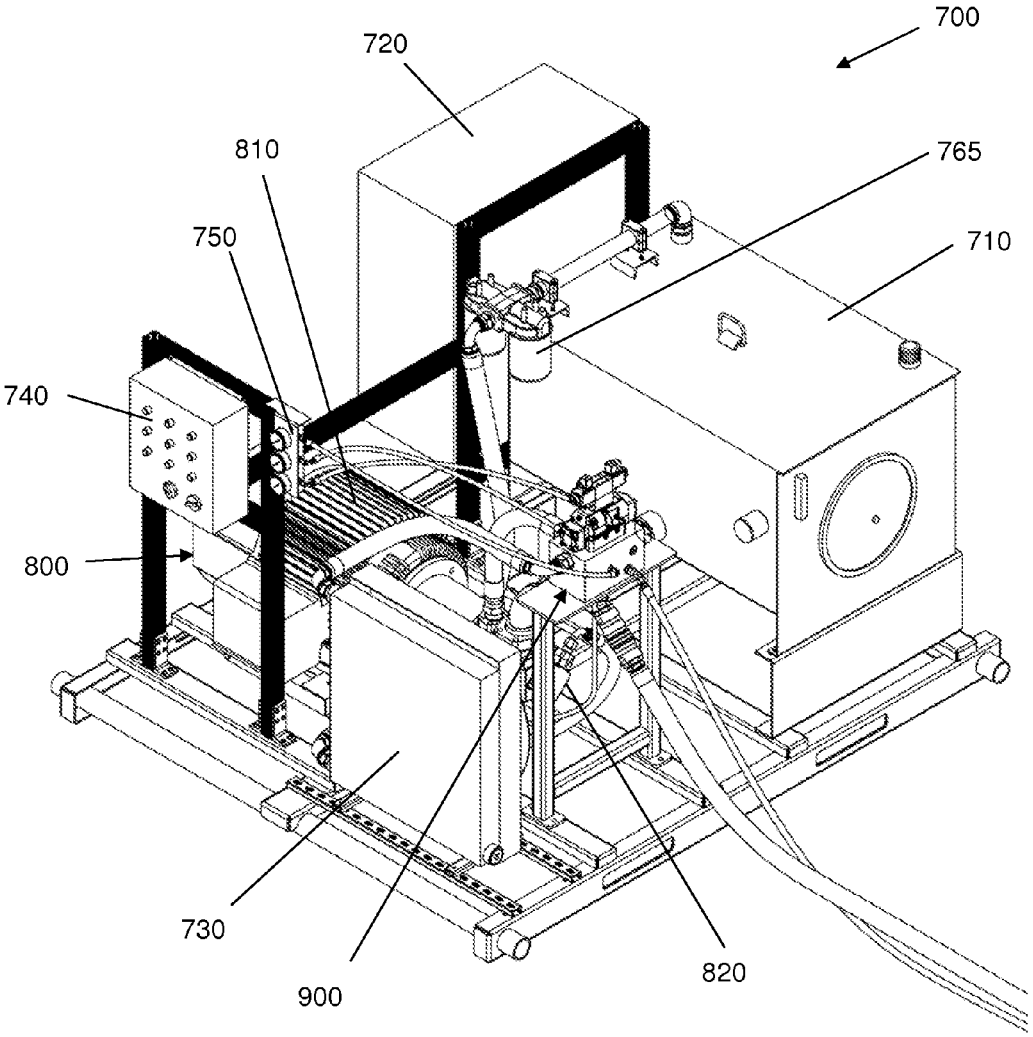
FIG. 12 is an isometric, view of a hydraulic power unit (HPU).

FIG. 12 is a more detailed isometric view of HPU 700 of FIG. 11. HPU 700 comprises reservoir 710 containing a hydraulic fluid. HPU 700 further comprises electric motor and pump assembly 800 comprising electric motor 810 and pump 820. Pump 820 can be, for example, a double-stage fixed displacement pump, that is coupled to electric motor 810 via pump coupling 812 and pump adapter 815 (shown in FIG. 13). In some embodiments the pump is coupled to an internal combustion engine rather than an electric motor. Motor 810 is connected to variable frequency drive (VFD) 720 which is connected to an AC power source (not shown). VFD 720 receives control commands from controller 740, which can be a programmable logic controller. Fluid inlet port 825 (see FIG. 13) on pump 820 is connected to reservoir 710 via suction hose and ball valve (shown schematically as components 755 and 760 in FIG. 15). Primary pressure port 835 (see FIG. 13) of pump 820 is connected to hydraulic manifold assembly 900 (shown in further detail in FIGS. 14A and 14B). Secondary pressure port 845 (see FIG. 13) of pump 820 is connected to an inlet of port of electric-motor driven air-hydraulic fluid heat exchanger 730, commonly called an oil-cooler. Fluid from secondary pressure port 845 (see FIG. 13) of pump 820 is circulated through oil-cooler 730 to reservoir 710, to maintain a desired hydraulic fluid temperature. Oil-cooler 730 is connected to reservoir 710 via return line filter 765. HPU 700 further comprises pressure gauges 750.

Figure 13:
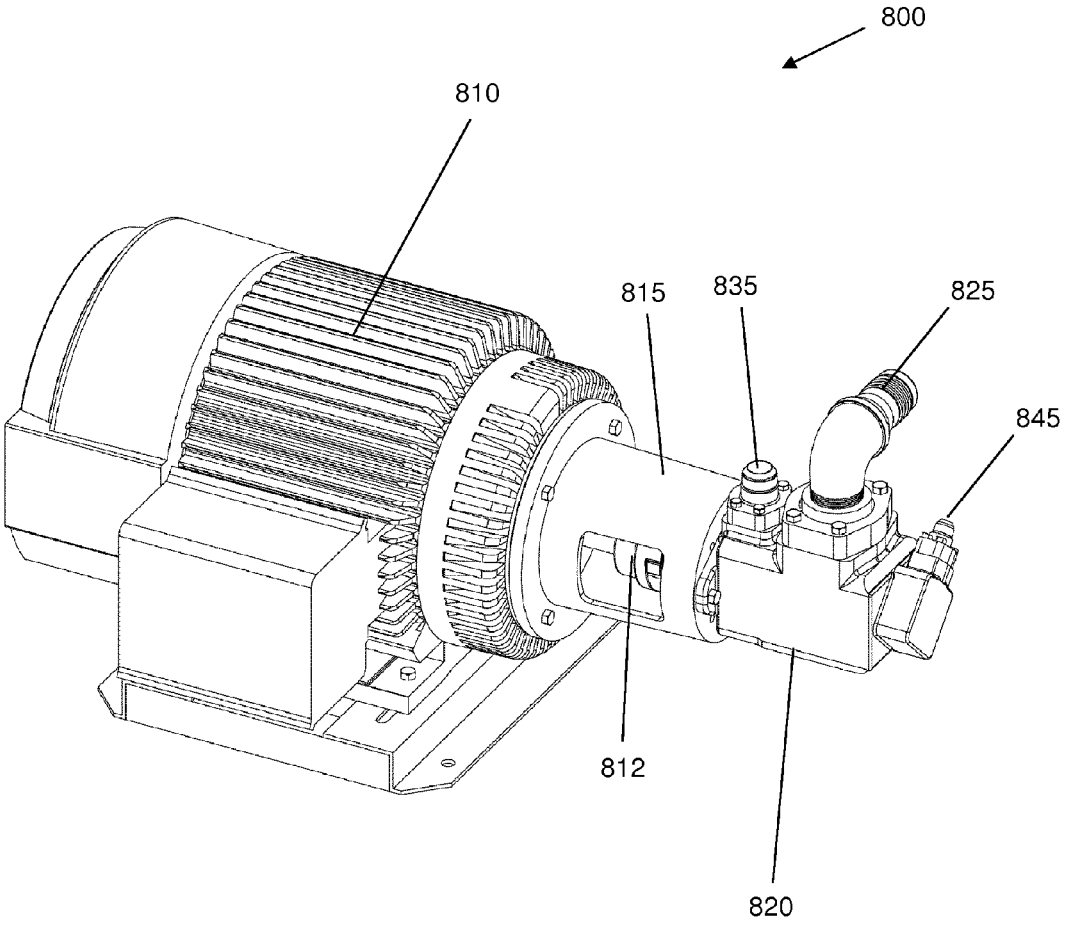
FIG. 13 is an isometric view of the pump and motor assembly of the hydraulic power unit (HPU) shown in FIG. 12.

FIG. 13 is a more detailed isometric view of pump and motor assembly 800 of HPU 700 shown in FIG. 12, showing electric motor 810, fixed displacement pump 820, pump coupling 812, pump adapter 815, fluid inlet port 825, primary pressure port 835 and secondary pressure port 845.

Figure 14A:
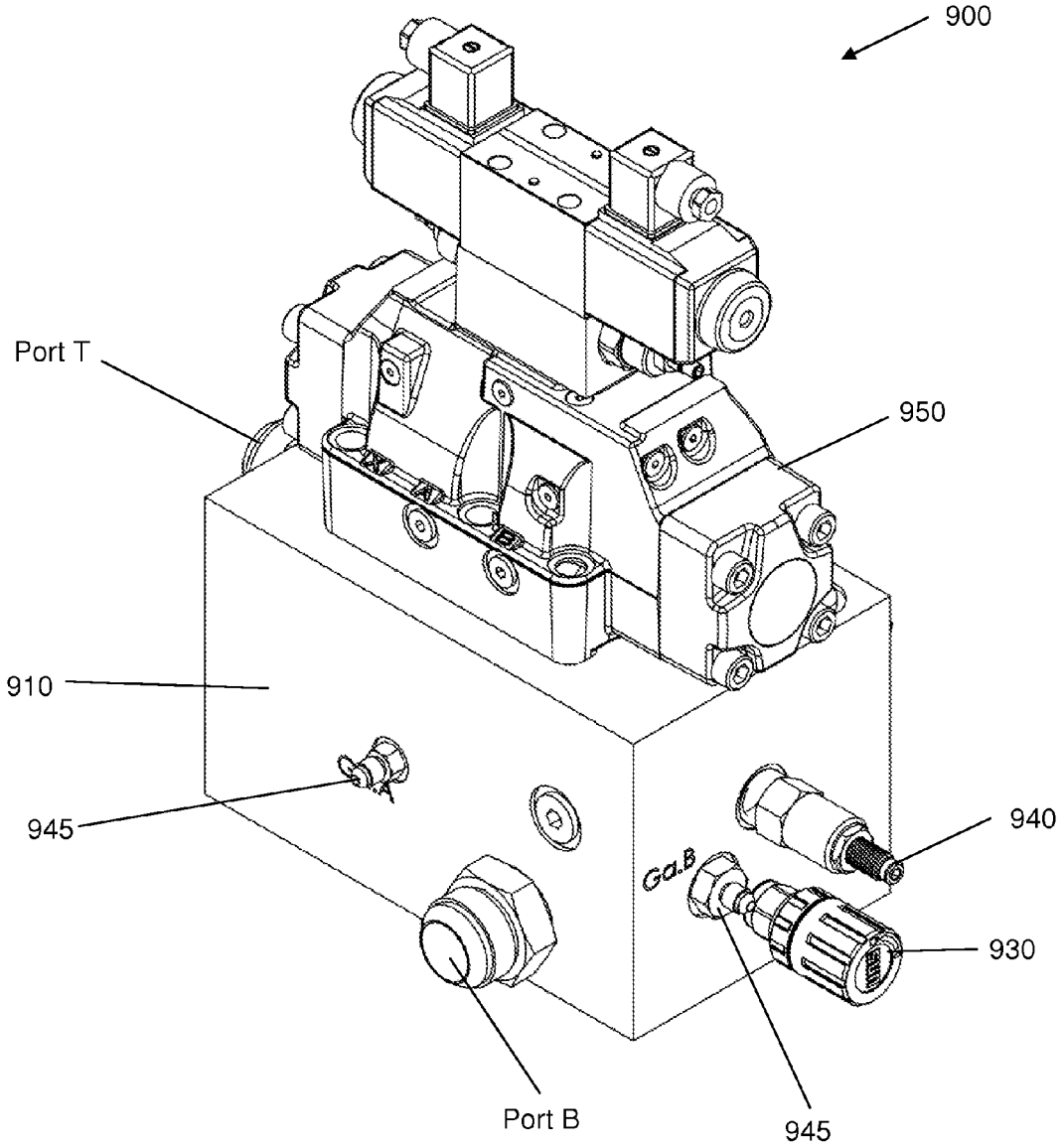
FIG. 14A is an isometric view of the hydraulic manifold assembly of the hydraulic power unit (HPU) shown in FIG. 12.
Figure 14B:
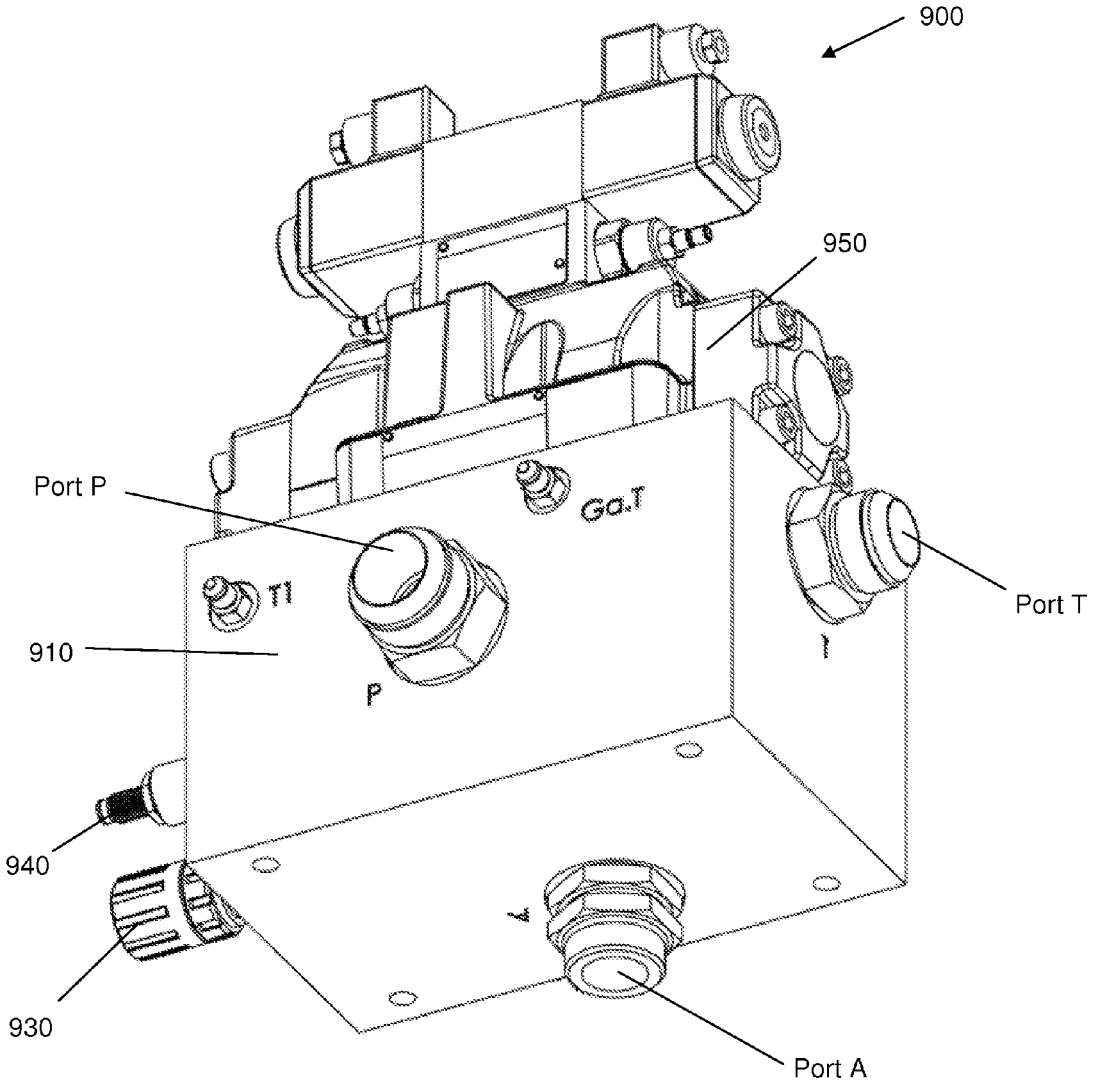
FIG. 14B is another isometric view of the hydraulic manifold assembly of the hydraulic power unit (HPU) shown in FIG. 12.

FIGS. 14A and 14B are more detailed isometric views of hydraulic manifold assembly 900 of HPU 700 shown in FIG. 12. Hydraulic manifold assembly 900 comprises hydraulic manifold 910 with a plurality of ports and fluid galleries which direct hydraulic fluid between pump 820 (shown in FIG. 12), hydraulic cylinder 605 (shown in FIG. 11), and reservoir 710 (shown in FIG. 12. Port A of hydraulic manifold assembly 900 (visible in FIG. 14B) is connected to lower port 612 of hydraulic cylinder 605. Port B on hydraulic manifold assembly 900 is connected to upper port 614 of hydraulic cylinder 605. Solenoid on/off valve 930 can be a two-position valve with positions controlled electronically via controller 740 (shown in FIG. 12). Hydraulic manifold assembly 900 also comprises a port for cartridge style pressure relief valve 940. Pressure relief valve 940 is a safety valve which opens when the system pressure exceeds a pressure set point on the valve. Exit port of relief valve 940 directs hydraulic fluid back to reservoir 710. Internal galleries and pressure gauge ports 945 connect pressure gauges 750 to various manifold ports to indicate pressure (see also FIGS. 15 to 18). Pump port (Port P) of hydraulic manifold assembly 900 is connected to primary pressure port 835 of pump 820. Tank port (Port T) of hydraulic manifold assembly 900 is connected to oil-cooler 730 (shown in FIG. 12). Mounted on top of the hydraulic manifold is proportional directional control valve 950. A proportional directional control valve is a common hydraulic device or component used to direct fluid flow between different ports based on the valve's spool position. Proportional directional control valve 950 also regulates fluid flow by adjusting a fluid orifice in proportion to a command signal received from controller 740. In the illustrated embodiment, a spring centered three-position, four-way proportional directional control valve is used. Valve 950 connects Port P to Port A, and Port B to Port T in one position. In a second position, Port P is connected to Port B, and Port A is connected to Port T. In a third (centered position). Ports A, B, P & T are closed. The position is determined by operation of two solenoids (see 955*a* and 955*b* in FIG. 15). When both solenoids are deactivated, spring returns valve 950 to a center position.

Figure 15:
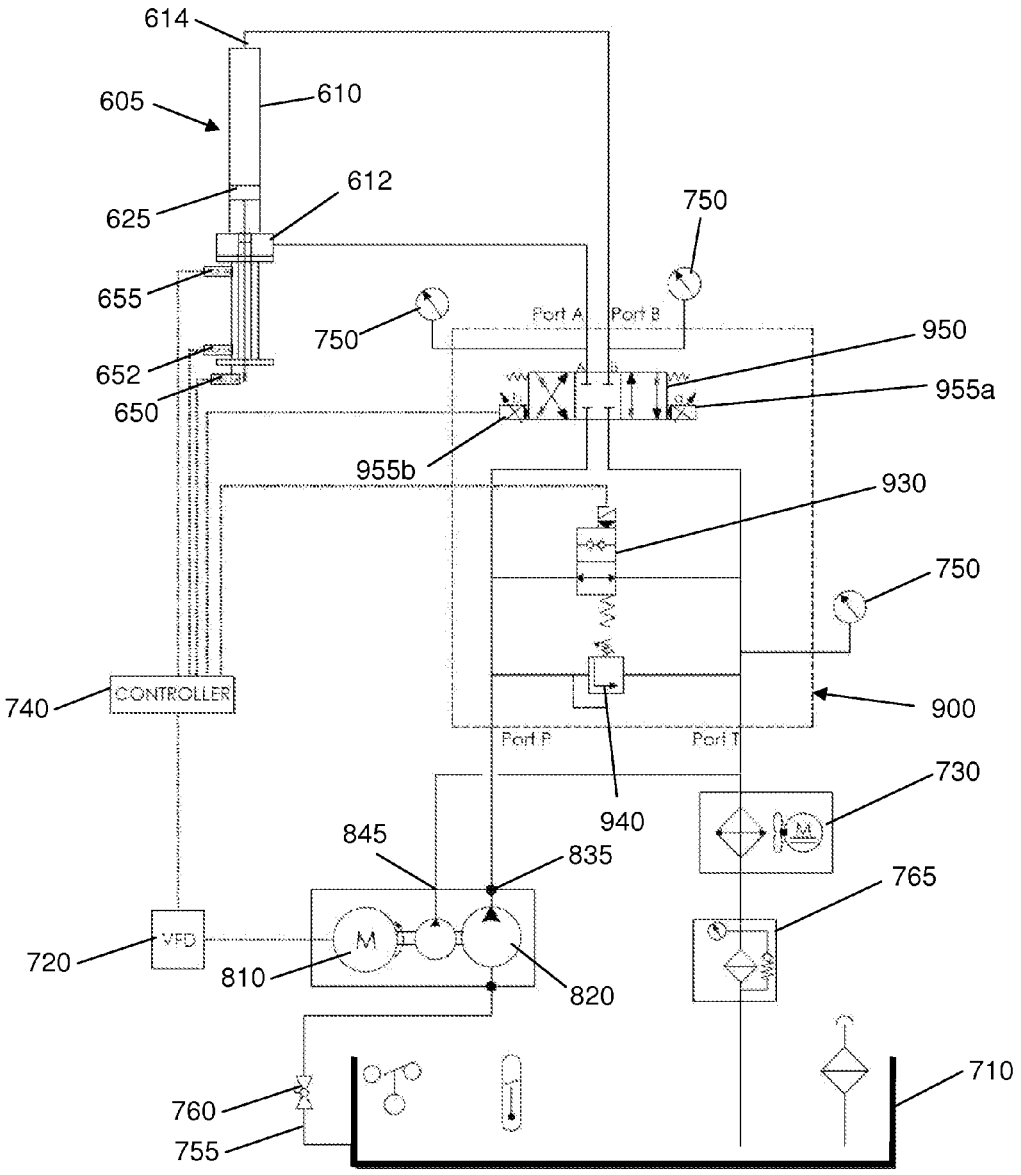
FIG. 15 is a schematic diagram showing an embodiment of a hydraulic system and pumping assembly.

FIG. 15 is a schematic illustration of the system shown in FIG. 11 showing a HPU coupled to direct hydraulic fluid to and from a pumping assembly. The same reference numerals are used in FIG. 15 to denote components of HPU 700 and pumping assembly 600 that are similar to or the same as those described in reference to earlier Figures.

Figure 16:
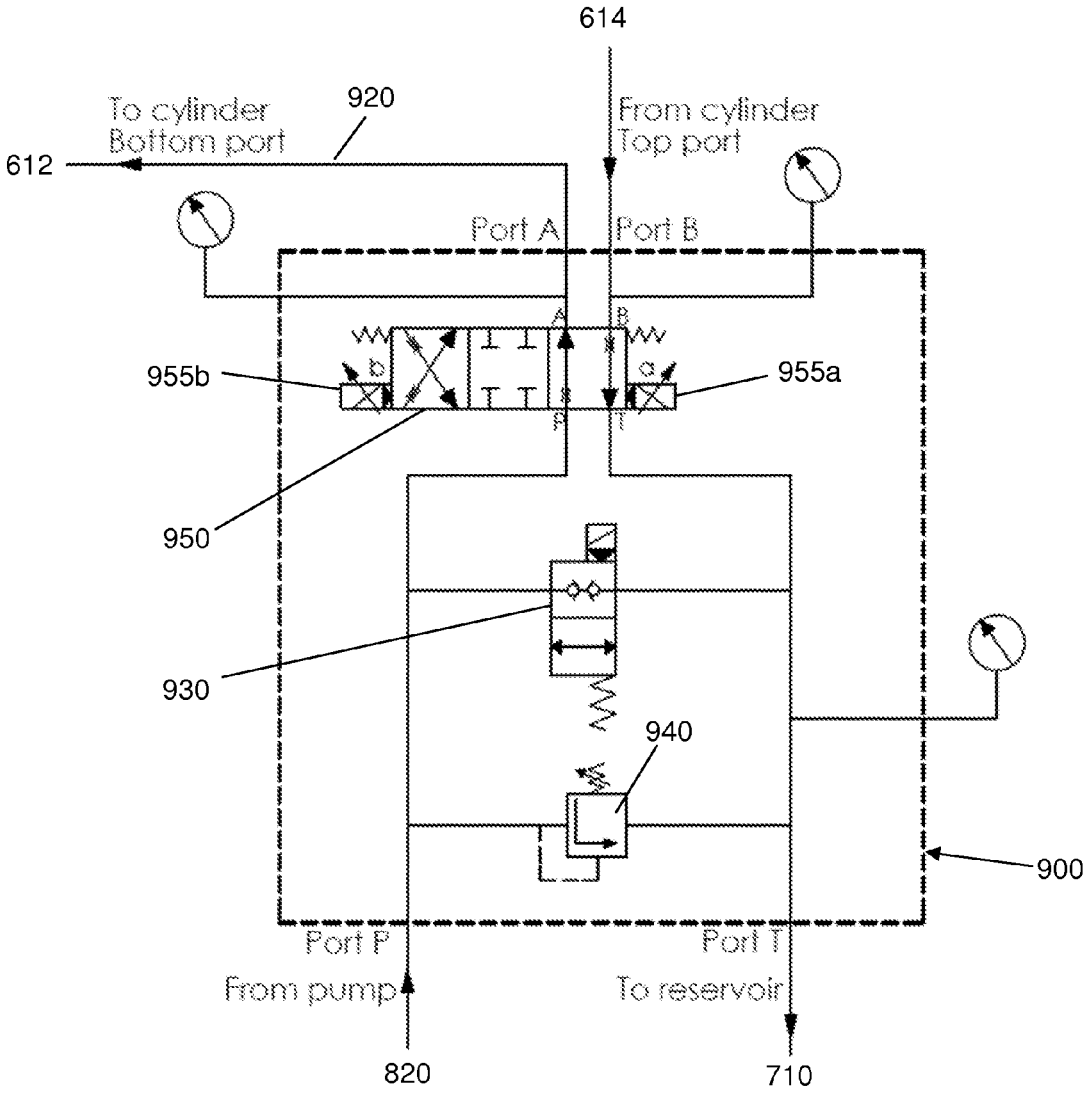
FIG. 16 is a schematic diagram showing a hydraulic configuration that can be used for the upstroke of the pumping assembly.
Figure 17:
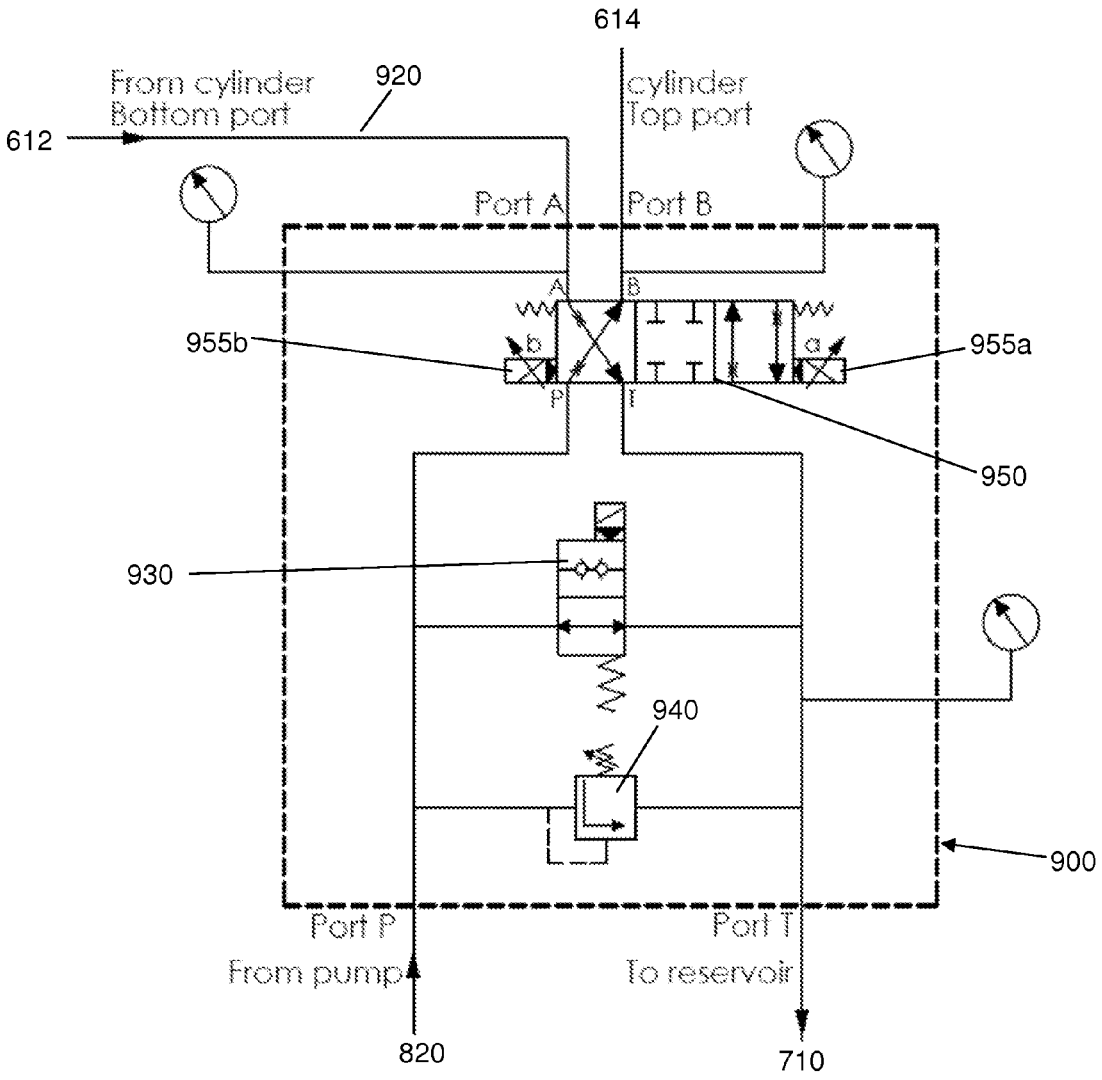
FIG. 17 is a schematic diagram showing a hydraulic configuration that can be used for a gravity-driven downstroke of the pumping assembly.
Figure 18:
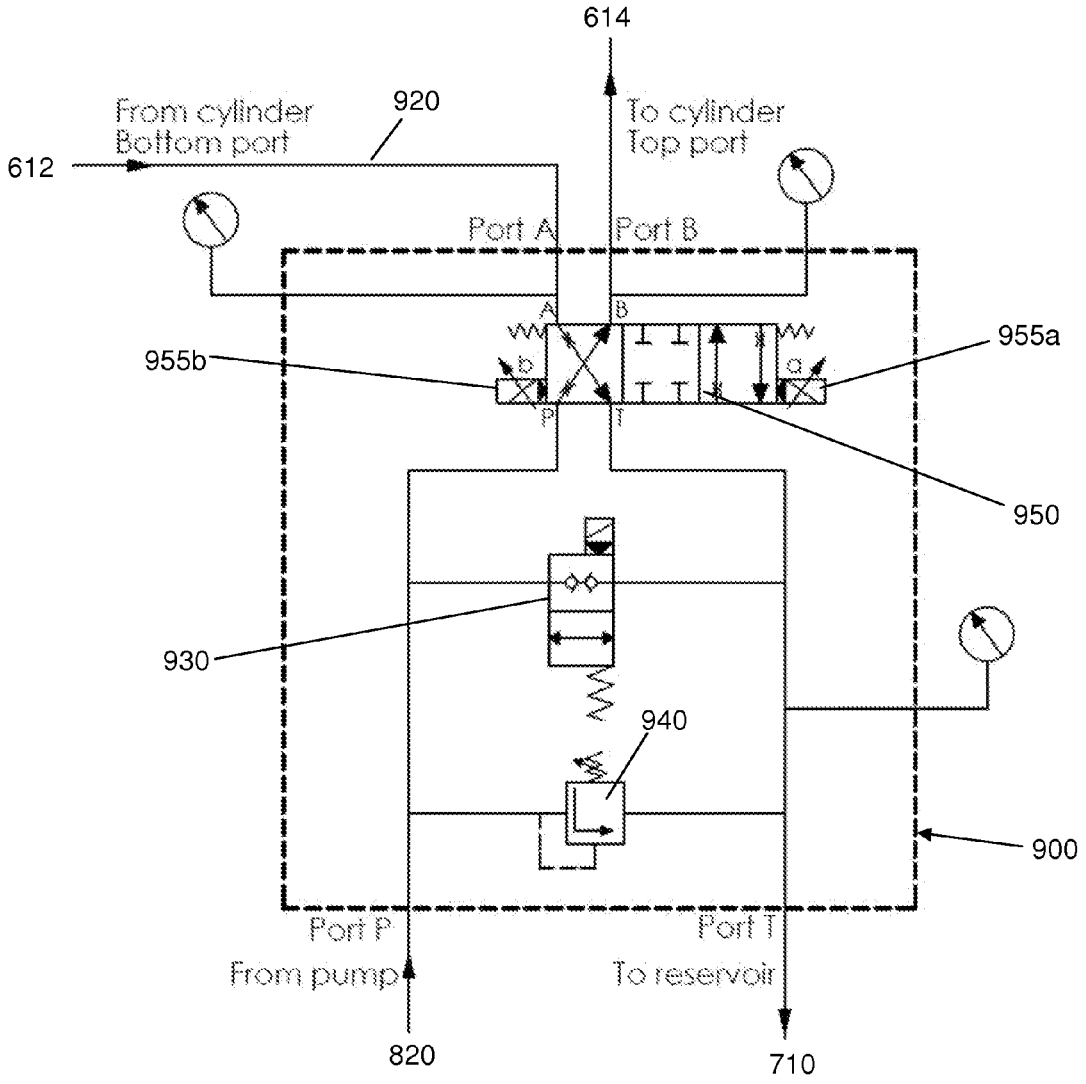
FIG. 18 is a schematic diagram showing a hydraulic configuration that can be used for a pressurized downstroke of the pumping assembly.

FIGS. 16-18 show different configurations of components of hydraulic manifold assembly 900 that are used during different stages of operation of the overall system. FIG. 16 shows a configuration that can be used for an upstroke of the pumping assembly. FIG. 17 shows a configuration that can be used for a gravity-driven downstroke of the pumping assembly. FIG. 18 shows a configuration that can be used for a pressurized downstroke of the pumping assembly. Operation of the system will now be described with reference to FIGS. 7, 11 and 15-18.

Upon start-up, the system runs in an idle state. VFD 720 runs motor 810 at less than half its rated speed and hydraulic fluid at a low flow rate is directed from pump primary pressure port 835 to Port P of hydraulic manifold assembly 900. Controller 740 sets proportional directional control valve 950 to a centered position and solenoid on/off valve 930 to an open position (as shown in FIG. 15). Hydraulic fluid within manifold assembly 900 is directed from Port P through solenoid on/off valve 930 to Port T (tank port). Hydraulic fluid flows from Port T to oil-cooler 730, then through return line filter 765 and back to reservoir 710. Secondary pressure port 845 of pump 820 directs hydraulic fluid to oil-cooler 730. Oil-cooler 730 cools the mixture of hydraulic fluid in the return line and fluid from secondary pressure port 845.

An operator enters a strokes per minute (SPM) input into controller 740 via a user interface, and then activates the system in an automatic operation mode, for example, by pressing a button. SPM is a parameter typically used to describe the speed of the system. One stroke refers to a full upstroke and downstroke actuation of the hydraulic cylinder. The SPM is converted within controller 740 to a motor speed which corresponds to a pump flow rate used to achieve the desired SPM. When the system is operating automatically, hydraulic fluid is directed from pump 820 to hydraulic manifold assembly 900. Controller 740 activates solenoid 955*a* on proportional directional control valve 950 to connect Port P to Port A (as shown in FIG. 16) while simultaneously setting solenoid on/off valve 930 to a closed position. Pressurized hydraulic fluid is delivered to lower port 612 of hydraulic, cylinder 605. Proportional directional control valve 950 can be operated at a full flow setting. In some embodiments, the initial upstroke speed is controlled by a gradual ramp up of motor 810 to prevent, or at least reduce, sudden acceleration of the rod string as the upstroke begins. This controlled ramp up can reduce stresses in the rod string.

As piston 625 rises within cylinder barrel. 610, cylinder rod 630 is lifted up within cylinder barrel 610 in what is referred to as a first flow cross-section phase. When polished rod connection 645 engages gland 675 within cylinder sleeve 670, it draws cylinder sleeve 670 up into cylinder barrel 610. This is a second flow cross-section phase. (These different flow cross-sections are discussed above in reference to FIG. 7.) When cylinder sleeve 670 begins to move, transition proximity sensor 652 is triggered by flange 678 on cylinder sleeve 670. This sends a signal to controller 740. The controller reduces the speed of motor 810 by a factor corresponding to the reduction in flow cross-section, so that the pump flow rate is reduced appropriately to maintain substantially the same linear speed for piston 625 during the second flow cross-section phase as in the first flow cross-section phase.

It can be seen from the schematic of FIG. 15 that fluid in the upper chamber of hydraulic cylinder 605 can be directed back to reservoir 710 on the upstroke.

As piston 625 rises, flange 678 on cylinder sleeve 670 eventually triggers upper proximity sensor 655. After receiving an upper proximity sensor signal, controller 740 initiates a timer for a period during which the motor speed is ramped down and, at the end of the period, activates solenoid 955*b* on proportional directional control valve 950 to connect Port A to Port T (as shown in FIG. 17). The purpose for ramping down the motor speed is to provide a smooth transition from upstroke to downstroke. On the downstroke, the weight of the rod string pulls piston 625 down within cylinder barrel 610, eventually causing cylinder sleeve 670 to retract into cylinder base 665. Fluid is discharged from lower port 612 of cylinder 605 to manifold assembly 900. Proportional directional control valve 950 on manifold assembly 900 regulates flow of hydraulic fluid from cylinder 605 in accordance with a command signal received from controller 740. Hydraulic fluid flows through oil-cooler 730 and return line filter 765 back to reservoir 710. Polished rod connection 645 will eventually reach the level of lower proximity sensor 650 and trigger it. Once controller 740 receives a lower proximity sensor signal, it initiates another upstroke cycle.

During normal operation on the downstroke, the upper chamber of hydraulic cylinder 605 is not pressurized. As hydraulic fluid is directed from Port A to Port T, proportional directional control valve 950 simultaneously directs hydraulic fluid from Port P to Port B. Port B is connected to upper port 614 of hydraulic cylinder 605. However, solenoid on/off valve 930 is set to an open position which directs fluid from Port P to Port T. The upper chamber of hydraulic cylinder 605 is not pressurized in this mode of operation, since oil is relieved, back to reservoir 710 via solenoid on/off valve 930. Since there is no significant flow requirement needed on the downstroke, motor 810 can be run at idle speed (for example, less than half of rated speed) to re-circulate hydraulic fluid to reservoir 710.

During installation or other maintenance operations when there is no load connected to cylinder rod 630 capable of actuating piston 625 downwards (or in other special situations), it may be desirable to be able to pressurize the upper chamber of hydraulic cylinder 605 to initiate a downstroke. To achieve this, controller 740 is set to manual mode and sends a signal to solenoid on/off valve 930 setting it in a closed position. When an operator initiates a manual downstroke command via controller 740, proportional directional control valve 950 directs flow from Port P to Port B which is connected to the upper chamber of hydraulic cylinder 605. Since flow through solenoid on/off valve 930 is blocked, pump pressure is built up in the upper chamber of hydraulic cylinder 605. As fluid enters the upper chamber of the cylinder via upper port 614, piston 625 moves down and forces hydraulic fluid out through lower port 612. The hydraulic fluid is directed from Port A of hydraulic manifold assembly 900 to Port T and back to reservoir 710 via oil-cooler 730 and return line filter 765.

Figure 1:
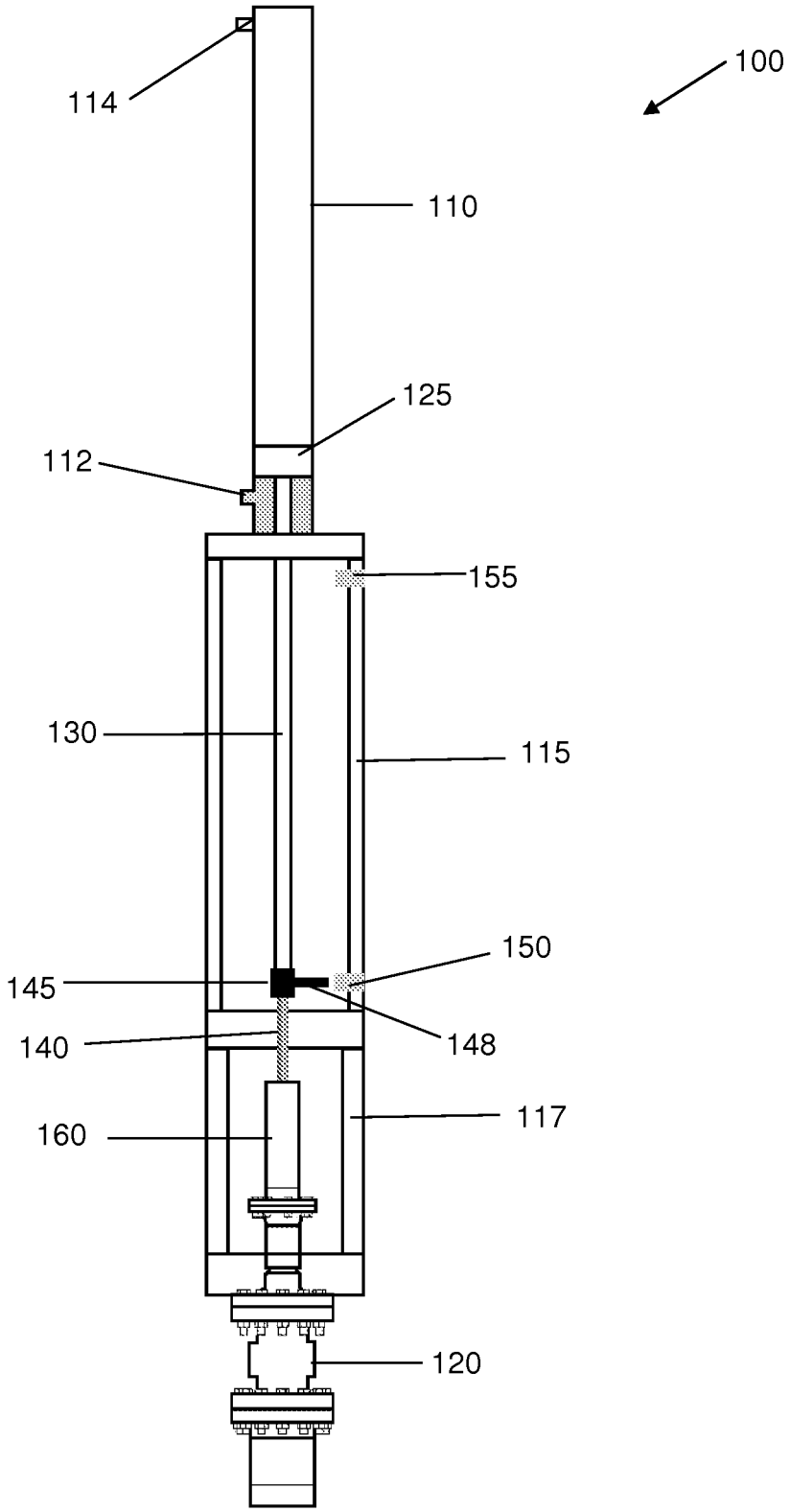
FIG. 1 (PRIOR ART)
FIG. 1 (prior art) is a simplified cross-sectional view of a pumping assembly comprising a hydraulic cylinder mounted atop a mast.
Figure 2:
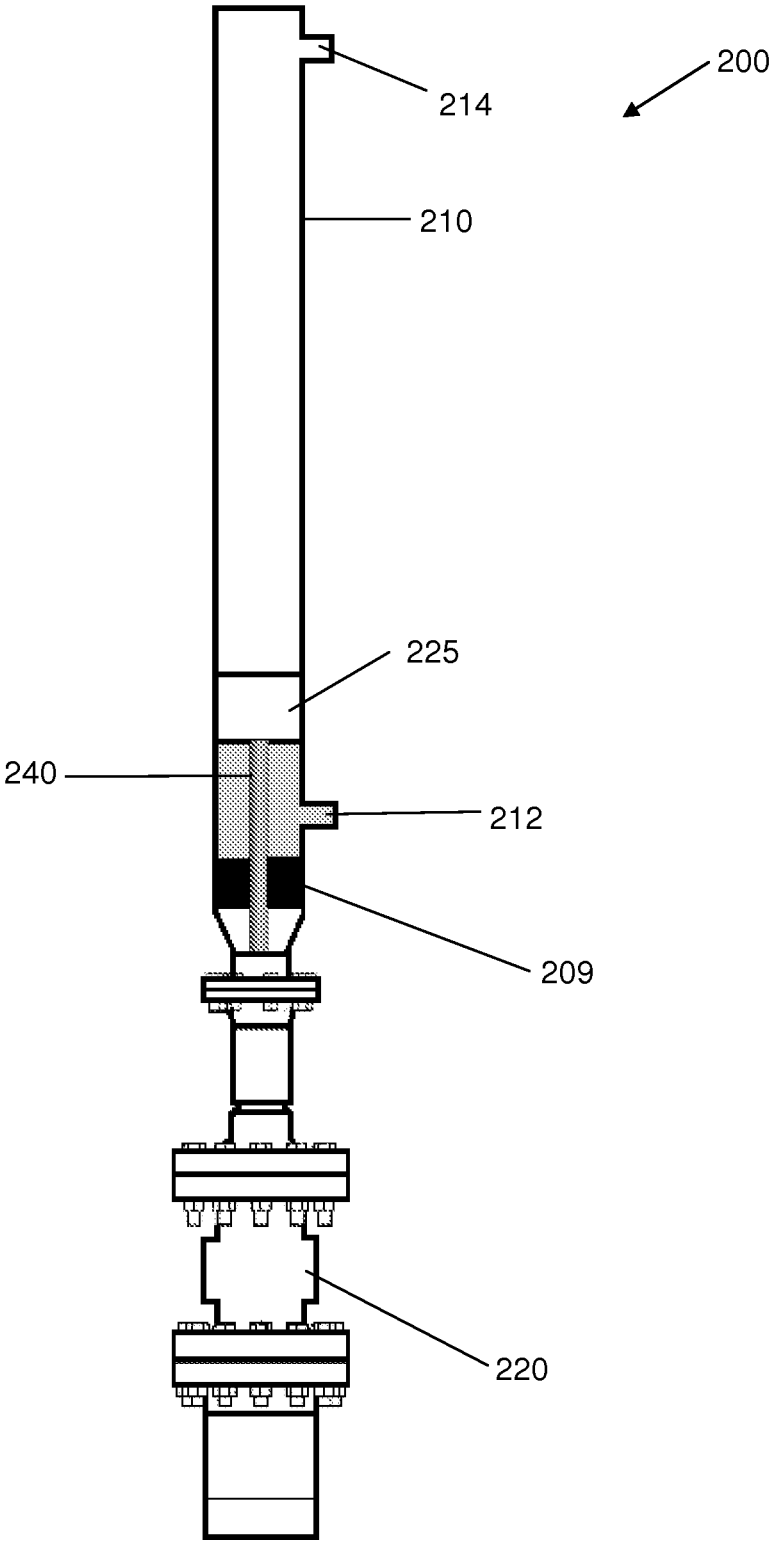
FIG. 2 (PRIOR ART)
FIG. 2 (prior art) is a simplified cross-sectional view of a pumping assembly comprising a hydraulic cylinder mounted directly on a wellhead.
Figure 3:
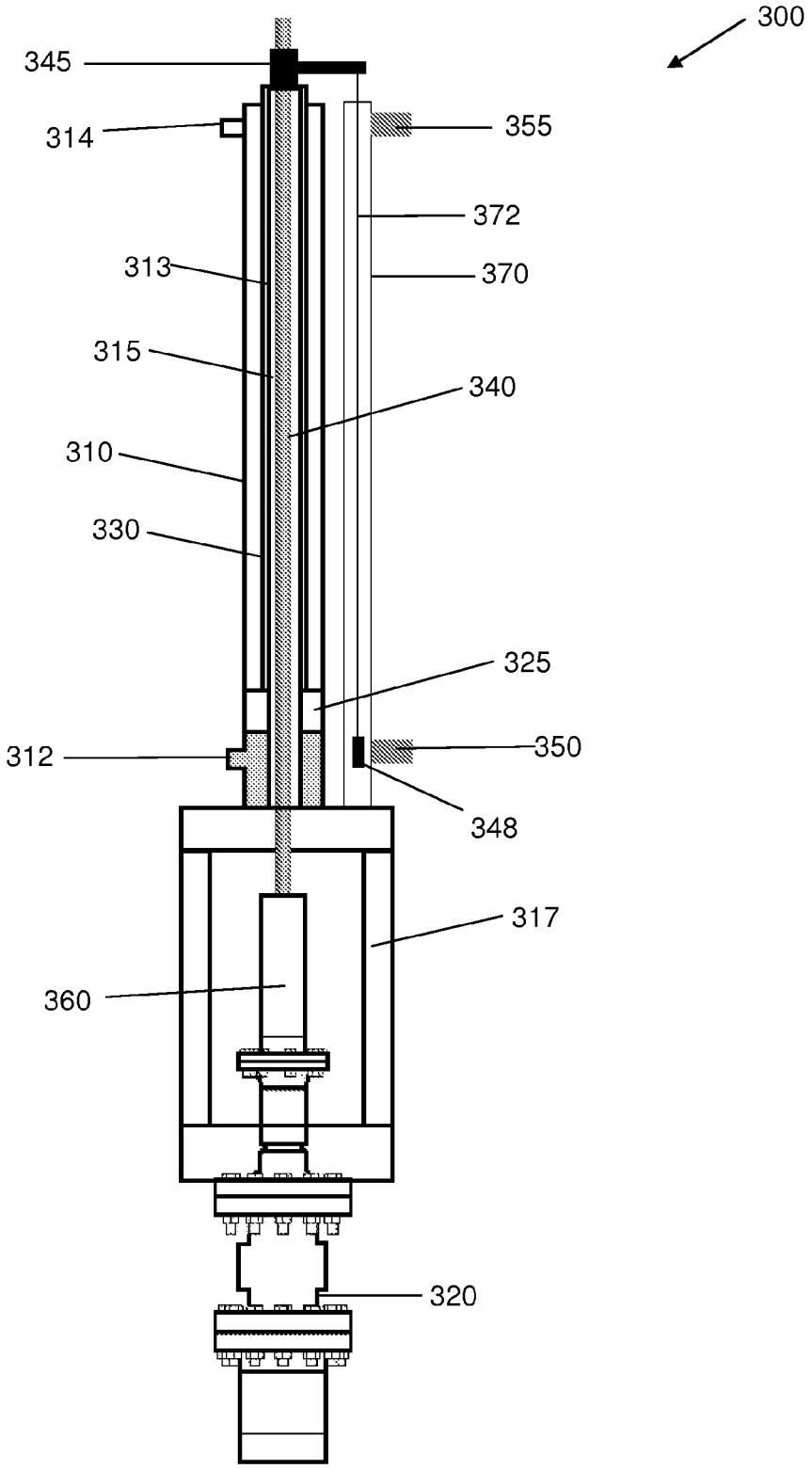
FIG. 3 (PRIOR ART)
FIG. 3 (prior art) is a simplified cross-sectional view of a pumping assembly comprising a annular hydraulic cylinder and piston.
Figure 4:
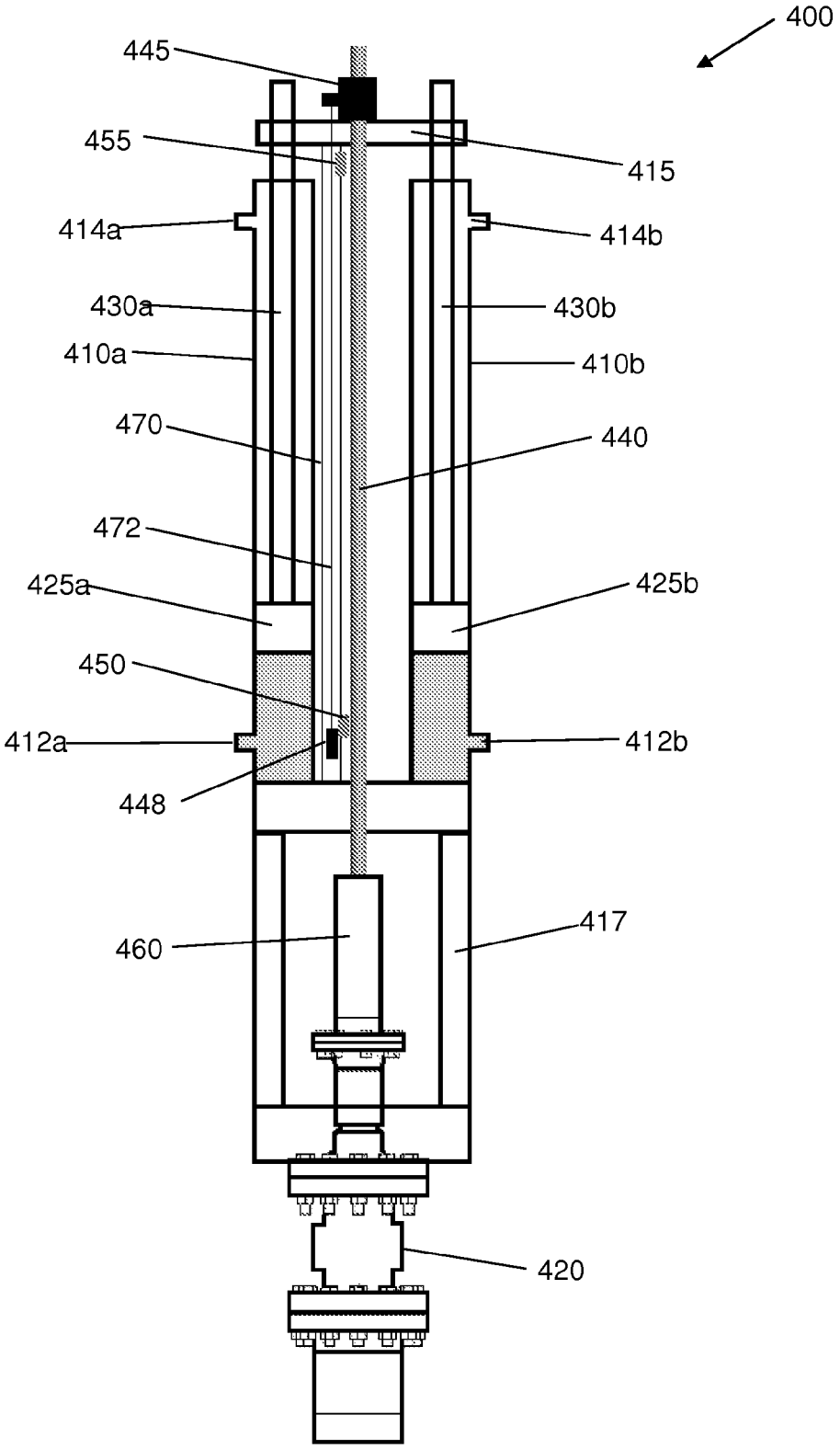
FIG. 4 (PRIOR ART)
FIG. 4 (prior art) is a simplified cross-sectional view of a pumping assembly comprising multiple hydraulic cylinders.
Figure 5:
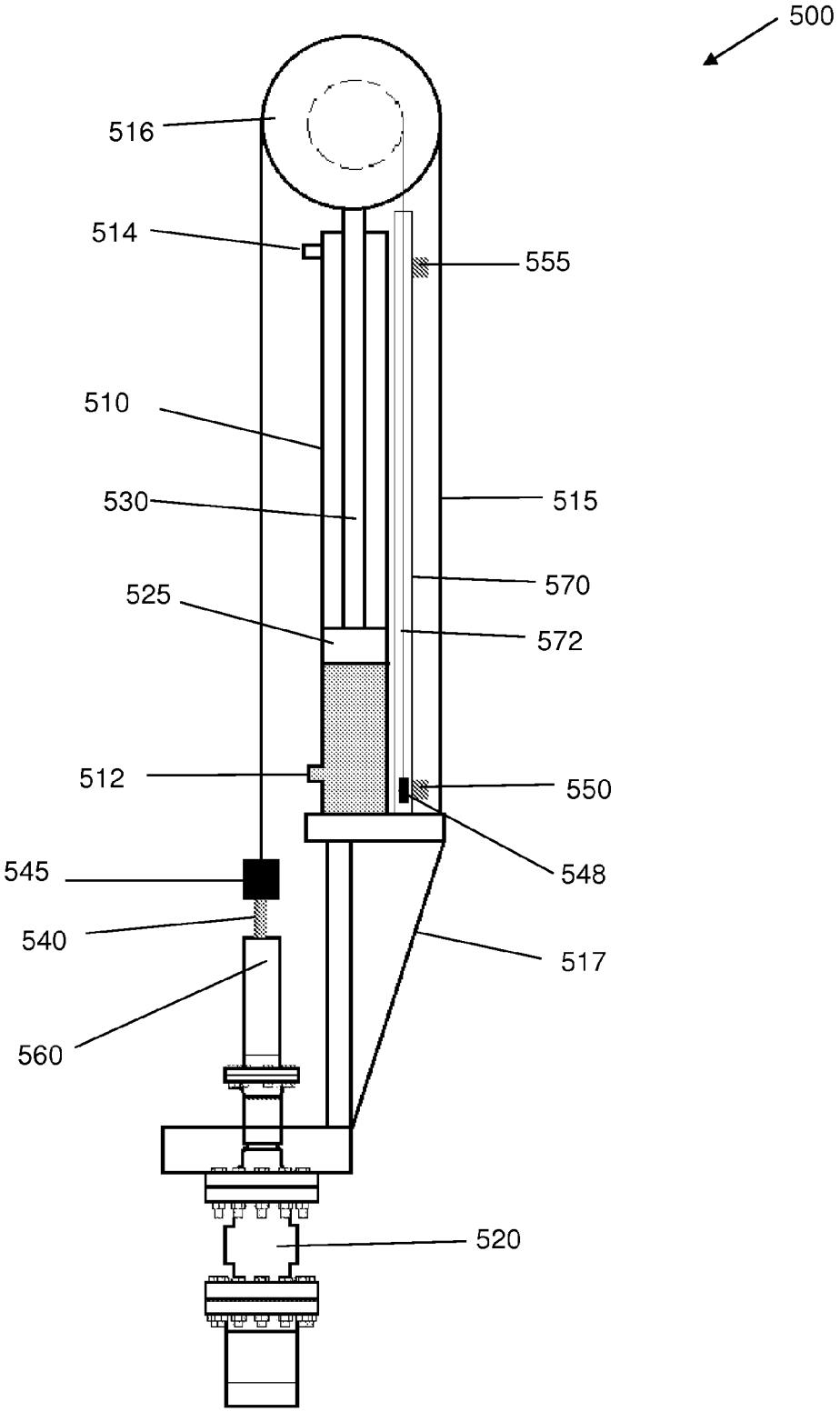
FIG. 5 (PRIOR ART)
FIG. 5 (prior art) is a simplified cross-sectional view of a pumping, assembly comprising a hydraulic cylinder and cable and drum/sheave assembly.

The system described herein provides a great deal of flexibility in operation. The upstroke and downstroke speeds can be independently controlled, and the stroke length can be adjusted, for example, by altering the position of upper proximity sensor 655. In addition, the total height and weight of the structure is reduced compared with the assemblies described in reference to FIGS. 1 and 4.

Figure 19:
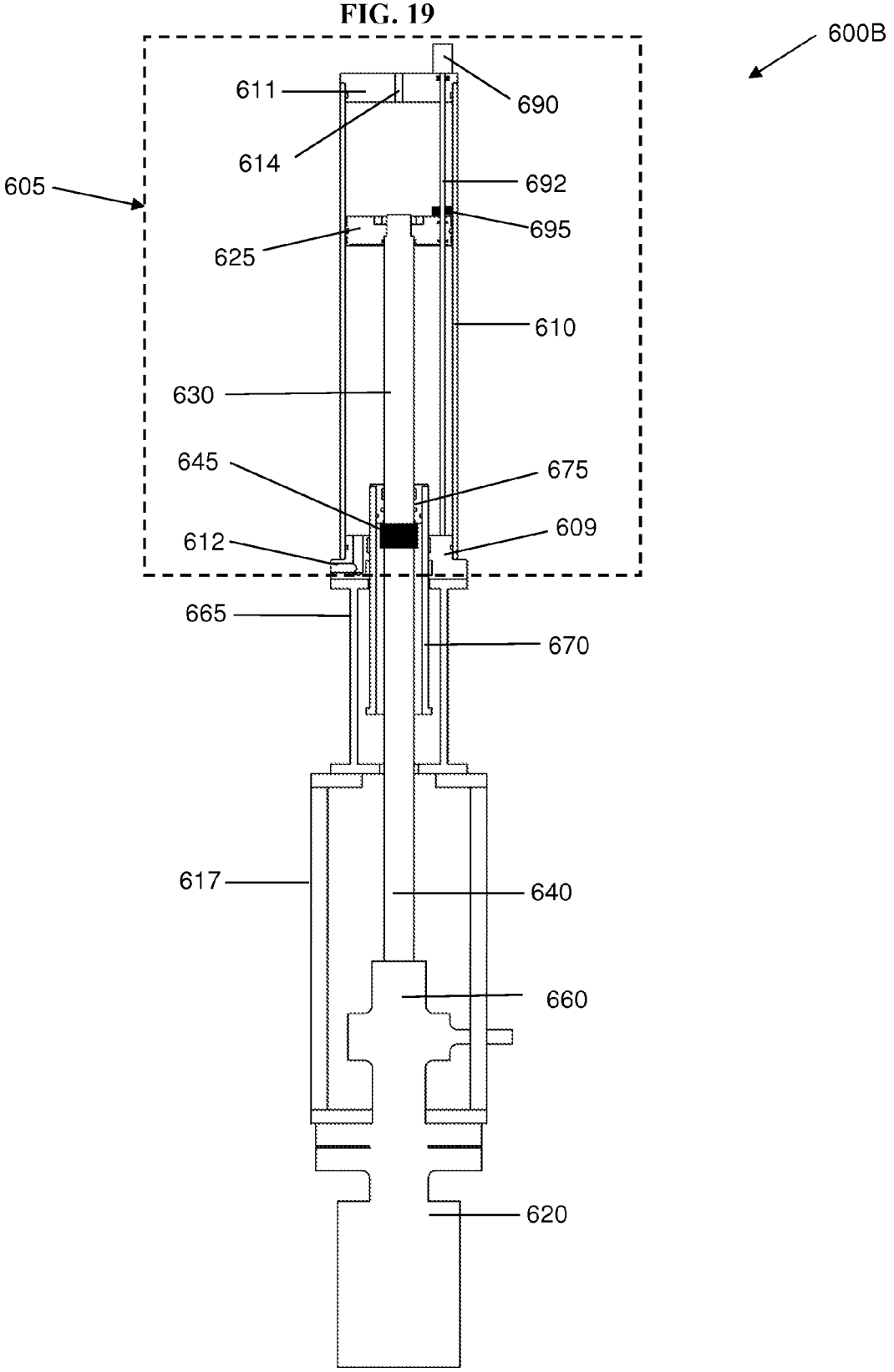
FIG. 19 is a simplified cross-sectional view of an embodiment of a pumping assembly, comprising a telescoping cylinder sleeve, a linear transducer and a hydraulic cylinder assembly shown in an intermediate position.

In the above described embodiments of a pumping assembly, system and method a linear transducer could be used instead of using proximity sensors as described. For example, FIG. 19 shows cross-sectional view of pumping assembly 600B similar to that illustrated in FIGS. 6 and 7, with the hydraulic cylinder shown in an intermediate position. The same reference numerals are used in FIG. 19 to denote components that are similar to or the same as those described in reference to FIGS. 6 and 7. Instead of sensors, pumping assembly 600B comprises a linear transducer assembly. The linear transducer assembly comprises transducer 690 mounted on top of cylinder cap 611, transducer rod 692 which is housed within cylinder barrel 610, and ring 695. Piston 625 and ring 695 slide up and down on transducer rod 692; ring 695 moves up and down with piston 625. Transducer 690 senses a position of ring 695 and provides this positional information to the controller (for example, 740). The controller can use this positional information to set or adjust the stroke length, and to control the speed of the motor to give the desired SPM, as well as to adjust the flow rate of the hydraulic fluid to compensate for the change in flow cross-section as the cylinder sleeve is deployed as described above.

In the above described embodiments of a pumping assembly, system and method, an accumulator or other suitable recapture mechanism can be used to capture some energy from the gravity-driven downstroke, and the stored energy can be applied during the upstroke to reduce the energy used to power the pumping assembly. On the downstroke, when the rod string falls under gravity, the motor speed can be reduced since the pump only circulates hydraulic fluid through the oil-cooler to the reservoir during this phase. This will reduce energy consumption.

While particular elements, embodiments and applications of the present invention have been shown and described, it will be understood, that the invention is not (muted thereto since modifications can be made by those skilled in the art without departing from the scope of the present disclosure, particularly in light of the foregoing teachings.

What is claimed is:

1. A hydraulic pumping assembly for providing reciprocating motion to a sucker rod string coupled to a downhole pump, said hydraulic pumping assembly comprising:

(a) a hydraulic cylinder comprising:

(i) a cylinder barrel;

(ii) a cylinder cap at an upper end of said cylinder barrel;

(iii) a cylinder head at a lower end of said cylinder barrel;

(iv) a piston; and (v) at least one port configured to direct a hydraulic fluid to and from said cylinder barrel, to cause said piston to reciprocate within said cylinder barrel;

(b) a cylinder rod wherein said piston is coupled to an upper end of said cylinder rod;

(c) a telescoping cylinder sleeve, wherein said cylinder rod slides within said cylinder sleeve and said cylinder sleeve passes slideably through said cylinder head, and wherein said cylinder sleeve telescopically moves between an extended position and a retracted position as said piston reciprocates within said cylinder barrel; and (d) a cylinder base positioned below said hydraulic cylinder, said cylinder base accommodating said cylinder rod and said telescoping cylinder sleeve in a collapsed position, wherein after a downstroke period, said piston is located near the bottom of said cylinder barrel and said telescoping cylinder sleeve surrounds said cylinder rod and is retracted within said cylinder base, and wherein during an upstroke period, said piston and said cylinder rod move up and, once said cylinder rod is almost fully retracted within said cylinder barrel, a feature associated with said cylinder rod engages said cylinder sleeve causing said cylinder sleeve to be drawn out from said cylinder base and into said cylinder barrel.

2. The hydraulic pumping assembly of claim 1, wherein during said downstroke period, said piston pushes said cylinder sleeve back into said cylinder base.

3. The hydraulic pumping assembly of claim 1, further comprising:

(e) a polished rod connection for coupling a lower end of said cylinder rod to said sucker rod string via a polished rod.

4. The hydraulic pumping assembly of claim 1, wherein a first port of said at least one port is located in said cylinder head and a second port of said at least one port is located in said cylinder cap.

5. The hydraulic pumping assembly of claim 1, wherein said pumping assembly further comprises a wellhead mount for coupling said pumping assembly to a wellhead, said wellhead mount coupled below said cylinder base.

6. The hydraulic pumping assembly of claim 1, further comprising:

(e) a linear transducer for sensing a position of said piston within said cylinder barrel.

7. The hydraulic pumping assembly of claim 1 further comprising:

(e) at least one proximity sensor for sensing a position of said piston within said cylinder barrel.

8. The hydraulic pumping assembly of claim 7, wherein said at least one proximity sensor comprises an upper proximity sensor for sensing when said piston reaches a desired upstroke position, a lower proximity sensor for sensing when said piston reaches a desired downstroke position, and a transition proximity sensor for sensing when said cylinder sleeve is drawn into said cylinder barrel.

9. The hydraulic pumping assembly of claim 8, wherein said proximity sensors comprise inductive proximity switches.

10. The hydraulic pumping assembly of claim 3, wherein said polished rod and said cylinder rod do not extend above the top of said hydraulic cylinder during operation of said hydraulic pumping assembly.

11. A method for operating the hydraulic pumping assembly of claim 1, said method comprising:

(a) supplying said hydraulic fluid to lift said piston within said cylinder barrel during an upstroke, and (b) adjusting a flow rate of said hydraulic fluid supplied to lift said piston such that said piston maintains substantially the same linear speed before and after said telescoping cylinder sleeve retracts into said cylinder barrel of said hydraulic cylinder during said upstroke.

12. A system for providing reciprocating motion to a sucker rod string coupled to a downhole pump, said system comprising:

(a) the hydraulic pumping assembly of claim 1; and (b) a hydraulic power unit for directing the hydraulic fluid to and from said hydraulic pumping assembly.

13. The system of claim 12, wherein said hydraulic power unit comprises:

(i) a reservoir containing said hydraulic fluid;

(ii) a pump fluidly connected to said reservoir;

(iii) a motor connected to a variable frequency drive, and coupled to said drive said pump;

(iv) a hydraulic manifold assembly for fluidly coupling said reservoir to said cylinder barrel; and (v) a controller configured to control said variable frequency drive thereby controlling the speed of said motor and a flow rate of said hydraulic fluid to said cylinder barrel via said hydraulic manifold assembly.

14. The system of claim 13, wherein said hydraulic manifold assembly comprises a plurality of valves.

15. The system of claim 13, wherein said hydraulic pumping assembly further comprises:

(e) a linear transducer for sensing a position of said piston within said cylinder barrel, and said controller is configured to control direction and speed of said piston based on signals from said linear transducer.

16. The system of claim 13, wherein said hydraulic pumping assembly further comprises:

(e) an upper proximity sensor for sensing when said piston reaches a desired upstroke position;

(f) a lower proximity sensor for sensing when said piston reaches a desired downstroke position; and (g) a transition proximity sensor for sensing when said cylinder sleeve is drawn into said cylinder barrel, and said controller is configured to control direction and speed of said piston based on signals from said upper, lower and transition proximity sensors.

17. The system of claim 16, wherein said controller is configured to adjust the speed of said piston when said transition proximity sensor is triggered.

18. A hydraulic pumping assembly for providing reciprocating motion to a sucker rod string coupled to a downhole pump, said hydraulic pumping assembly comprising:

(a) a hydraulic cylinder comprising:

(i) a cylinder barrel;

(ii) a cylinder cap at an upper end of said cylinder barrel;

(iii) a cylinder head at a lower end of said cylinder barrel;

(iv) a piston; and (v) at least one port configured to direct a hydraulic fluid to and from said cylinder barrel, to cause said piston to reciprocate within said cylinder barrel;

(b) a cylinder rod wherein said piston is coupled to an upper end of said cylinder rod;

(c) a telescoping cylinder sleeve, wherein said cylinder rod slides within said cylinder sleeve and said cylinder sleeve passes slideably through said cylinder head, and wherein said cylinder sleeve telescopically moves between an extended position and a retracted position as said piston reciprocates within said cylinder barrel;

(d) a cylinder base positioned below said hydraulic cylinder, said cylinder base accommodating said cylinder rod and said telescoping cylinder sleeve in a collapsed position;

and (e) an upper proximity sensor for sensing when said piston reaches a desired upstroke position, a lower proximity sensor for sensing when said piston reaches a desired downstroke position, and a transition proximity sensor for sensing when said cylinder sleeve is drawn into said cylinder barrel.

19. A system for providing reciprocating motion to a sucker rod string coupled to a downhole pump, said system comprising:

(a) a hydraulic pumping assembly wherein said hydraulic pumping assembly comprises:

(i) a hydraulic cylinder comprising:

(1) a cylinder barrel;

(2) a cylinder cap at an upper end of said cylinder barrel;

(3) a cylinder head at a lower end of said cylinder barrel;

(4) a piston; and (5) at least one port configured to direct hydraulic fluid to and from said cylinder barrel, to cause said piston to reciprocate within said cylinder barrel;

(ii) a cylinder rod, said piston coupled to an upper end of said cylinder rod;

(iii) a telescoping cylinder sleeve, wherein said cylinder rod slides within said cylinder sleeve and said cylinder sleeve passes slideably through said cylinder head, and wherein said cylinder sleeve telescopically moves between an extended position and a retracted position as said piston reciprocates within said cylinder barrel;

(iv) a cylinder base positioned below said hydraulic cylinder, said cylinder base accommodating said cylinder rod and said telescoping cylinder sleeve in a collapsed position;

(v) an upper proximity sensor for sensing when said piston reaches a desired upstroke position;

(vi) a lower proximity sensor for sensing when said piston reaches a desired downstroke position; and (vii) a transition proximity sensor for sensing when said cylinder sleeve is drawn into said cylinder barrel, and said controller is configured to control direction and speed of said piston based on signals from said upper, lower and transition proximity sensors; and (b) a hydraulic power unit for directing a hydraulic fluid to and from said hydraulic pumping assembly wherein said hydraulic power unit comprises:

(i) a reservoir containing said hydraulic fluid;

(ii) a pump fluidly connected to said reservoir;

(iii) a motor connected to a variable frequency drive, and coupled to said drive said pump;

(iv) a hydraulic manifold assembly for fluidly coupling said reservoir to said cylinder barrel; and (v) a controller configured to control said variable frequency drive thereby controlling the speed of said motor and a flow rate of said hydraulic fluid to said cylinder barrel via said hydraulic manifold assembly.

* * * * *